US006885834B2

(12) United States Patent
Ito et al.

(10) Patent No.: US 6,885,834 B2
(45) Date of Patent: Apr. 26, 2005

(54) PRINTING APPARATUS

(75) Inventors: Mitsuhiro Ito, Shizuoka (JP); Hiroaki Sakai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/625,880

(22) Filed: Jul. 24, 2003

(65) Prior Publication Data

US 2004/0022551 A1 Feb. 5, 2004

(30) Foreign Application Priority Data

Jul. 31, 2002 (JP) ..... 2002-224205

(51) Int. Cl.[7] ..... G03G 15/00; G03G 15/20

(52) U.S. Cl. ..... 399/67; 399/16; 399/82; 399/401

(58) Field of Search ..... 399/67, 68, 69, 399/38, 43, 16, 75, 76, 82, 401

(56) References Cited

U.S. PATENT DOCUMENTS

| | | | | |
|---|---|---|---|---|
| 5,449,162 A | | 9/1995 | Saito et al. | 271/122 |
| 5,493,378 A | * | 2/1996 | Jamzadeh et al. | 399/67 X |
| 5,682,576 A | | 10/1997 | Sakai et al. | 399/69 |
| 5,819,134 A | | 10/1998 | Sato et al. | 399/69 |
| 5,904,871 A | | 5/1999 | Sakai et al. | 219/216 |
| 6,741,819 B1 | * | 5/2004 | Han | 399/82 |
| 6,754,456 B1 | * | 6/2004 | Ahn | 399/75 |
| 2003/0235449 A1 | * | 12/2003 | Ahn | 399/401 |
| 2004/0005159 A1 | * | 1/2004 | Ito et al. | 399/50 |

FOREIGN PATENT DOCUMENTS

| | | |
|---|---|---|
| JP | 06-019255 | 1/1994 |
| JP | 8-320642 | 12/1996 |
| JP | 9-146391 | 6/1997 |
| JP | 2002-91102 | 3/2002 |

* cited by examiner

*Primary Examiner*—Sophia S. Chen
(74) *Attorney, Agent, or Firm*—Fitzpatrick, Cella, Harper & Scinto

(57) ABSTRACT

A printing apparatus can reduce wasted power consumption, and prolong the life of an image forming section and fixing pressurizing rollers. It includes a printer control unit including a video controller and engine controller. According to a print reservation from the video controller, the engine controller controls a paper transport mechanism such as feed rollers, transport rollers and lifters, thereby feeding paper from a paper inlet designated by a printing condition. The engine controller controls a laser scanner unit to transfer a formed image to a sheet with a high voltage unit, and fixes it by a fixing assembly. It controls the paper transport mechanism to output the paper to the paper outlet designated by the printing condition. The image forming section and fixing pressurizing rollers are individually rotatable. Their rotation is stoppable individually without interference in a time from printing the first side to reversing and refeeding the paper.

27 Claims, 51 Drawing Sheets

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEED WAITING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.4A

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEEDING | NONE |
| 2 | 4 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.4B

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PRINTING | NONE |
| 2 | 4 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.4C

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | DOUBLE SIDE TRANSPORTING | NONE |
| 2 | 4 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.4D

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | SECOND SIDE MANAGEMENT | NONE |
| 2 | 4 | DOUBLE SIDES | PAPER DISCHARGING TRAY | A4 | PAPER FEEDING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.4E

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | SECOND SIDE MANAGEMENT | NONE |
| 2 | 4 | DOUBLE SIDES | PAPER DISCHARGING TRAY | A4 | PRINTING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.4F

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.4G

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEED WAITING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.5A

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEEDING | NONE |
| 2 | 7 | UPPER CASSETTE | DOUBLE SIDES | A4 | PAPER FEED WAITING | NONE |
| 3 | 4 | DOUBLE SIDE | PAPER DISCHARGING TRAY | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.5B

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PRINTING | NONE |
| 2 | 7 | UPPER CASSETTE | DOUBLE SIDES | A4 | PAPER FEEDING | NONE |
| 3 | 4 | DOUBLE SIDE | PAPER DISCHARGING TRAY | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.5C

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | DOUBLE SIDE TRANSPORTING | NONE |
| 2 | 7 | UPPER CASSETTE | DOUBLE SIDES | A4 | PRINTING | NONE |
| 3 | 4 | DOUBLE SIDE | PAPER DISCHARGING TRAY | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.5D

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | SECOND SIDE MANAGEMENT | NONE |
| 2 | 7 | UPPER CASSETTE | DOUBLE SIDES | A4 | DOUBLE SIDE TRANSPORTING | NONE |
| 3 | 4 | DOUBLE SIDE | PAPER DISCHARGING TRAY | A4 | PAPER FEEDING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.5E

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | SECOND SIDE MANAGEMENT | NONE |
| 2 | 7 | UPPER CASSETTE | DOUBLE SIDES | A4 | SECOND SIDE MANAGEMENT | NONE |
| 3 | 4 | DOUBLE SIDE | PAPER DISCHARGING TRAY | A4 | PRINTING | NONE |
| 4 | 7 | DOUBLE SIDES | PAPER DISCHARGING TRAY | A4 | PAPER FEEDING | NONE |
| 0(INVALID) | UNDEFINED | UNDEFINED | UNDEFINED | UNDEFINED | UNDEFINED | UNDEFINED |

FIG.5F

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 2 | 7 | UPPER CASSETTE | DOUBLE SIDES | A4 | SECOND SIDE MANAGEMENT | NONE |
| 0(INVALID) | UNDEFINED | UNDEFINED | UNDEFINED | UNDEFINED | UNDEFINED | UNDEFINED |
| 4 | 7 | DOUBLE SIDES | PAPER DISCHARGING TRAI | A4 | PRINTING | NONE |
| 0(INVALID) | UNDEFINED | UNDEFINED | UNDEFINED | UNDEFINED | UNDEFINED | UNDEFINED |

FIG.5G

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.5H

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEED WAITING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.6A

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEEDING | NONE |
| 2 | 7 | UPPER CASSETTE | DOUBLE SIDES | A4 | PAPER FEED WAITING | NONE |
| 3 | 4 | DOUBLE SIDES | PAPER DISCHARGING TRAY | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.6B

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PRINTING | NONE |
| 2 | 7 | UPPER CASSETTE | DOUBLE SIDES | A4 | PAPER FEED WAITING | PAPER-OUT ERROR |
| 3 | 4 | DOUBLE SIDES | PAPER DISCHARGING TRAY | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.6C

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | DOUBLE SIDE TRANSPORTING | NONE |
| 2 | 7 | UPPER CASSETTE | DOUBLE SIDES | A4 | PAPER FEED WAITING | PAPER-OUT ERROR |
| 3 | 4 | DOUBLE SIDES | PAPER DISCHARGING TRAY | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.6D

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | SECOND SIDE MANAGEMENT | NONE |
| 2 | 7 | UPPER CASSETTE | DOUBLE SIDES | A4 | PAPER FEED WAITING | PAPER-OUT ERROR |
| 3 | 4 | DOUBLE SIDES | PAPER DISCHARGING TRAY | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.6E

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEED WAITING | NONE |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.13A

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PAPER FEEDING | NONE |
| 2 | 4 | DOUBLE SIDES | PAPER DISCHARGING TRAY | A4 | PAPER FEED WAITING | NONE |
| 3 | 7 | UPPER CASSETTE | DOUBLE SIDES | A4 | PAPER FEED WAITING | NONE |
| 4 | 7 | DOUBLE SIDES | OUTPUT TRAY | A4 | PAPER FEED WAITING | NONE |
| 0(INVALID) | UNDEFINED | UNDEFINED | UNDEFINED | UNDEFINED | UNDEFINED | UNDEFINED |

FIG.13B

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | PRINTING | NONE |
| 2 | 4 | DOUBLE SIDES | PAPER DISCHARGING TRAY | A4 | PAPER FEED WAITING | NONE |
| 3 | 7 | UPPER CASSETTE | DOUBLE SIDES | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.13C

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | DOUBLE SIDE TRANSPORTING | NONE |
| 2 | 4 | DOUBLE SIDES | PAPER DISCHARGING TRAY | A4 | PAPER FEED WAITING | NONE |
| 3 | 7 | UPPER CASSETTE | DOUBLE SIDES | A4 | PAPER FEED WAITING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.13D

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | SECOND SIDE MANAGEMENT | NONE |
| 2 | 4 | DOUBLE SIDES | PAPER DISCHARGING TRAY | A4 | PAPER FEEDING | NONE |
| 3 | 7 | UPPER CASSETTE | DOUBLE SIDES | A4 | PAPER FEEDING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.13E

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 1 | 4 | UPPER CASSETTE | DOUBLE SIDES | A4 | SECOND SIDE MANAGEMENT | NONE |
| 2 | 4 | DOUBLE SIDES | PAPER DISCHARGING TRAY | A4 | PRINTING | NONE |
| 3 | 7 | UPPER CASSETTE | DOUBLE SIDES | A4 | PAPER FEEDING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.13F

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 3 | 7 | UPPER CASSETTE | DOUBLE SIDES | A4 | PRINTING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.13G

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 3 | 7 | UPPER CASSETTE | DOUBLE SIDES | A4 | DOUBLE SIDE TRANSPORTING | NONE |
| 4 | 7 | DOUBLE SIDES | PAPER DISCHARGING TRAY | A4 | PAPER FEED WAITING | NONE |
| 0(INVALID) | UNDEFINED | UNDEFINED | UNDEFINED | UNDEFINED | UNDEFINED | UNDEFINED |

FIG.13H

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 3 | 7 | UPPER CASSETTE | DOUBLE SIDES | A4 | SECOND SIDE MANAGEMENT | NONE |
| 4 | 7 | DOUBLE SIDES | PAPER DISCHARGING TRAY | A4 | PAPER FEEDING | NONE |
| 0(INVALID) | UNDEFINED | UNDEFINED | UNDEFINED | UNDEFINED | UNDEFINED | UNDEFINED |

FIG.13 I

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 3 | 7 | UPPER CASSETTE | DOUBLE SIDES | A4 | SECOND SIDE MANAGEMENT | NONE |
| 4 | 7 | DOUBLE SIDES | PAPER DISCHARGING TRAY | A4 | PRINTING | NONE |
| 0(INVALID) | UNDEFINED | UNDEFINED | UNDEFINED | UNDEFINED | UNDEFINED | UNDEFINED |

FIG.13J

| | PRINTING CONDITIONS | | | MANAGEMENT INFORMATION | | |
|---|---|---|---|---|---|---|
| PRINTING SEQUENCE | ID NUMBER | PAPER INLET | PAPER OUTLET | PAPER SIZE | MODE | ERROR |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |
| 0(INVALID) | UNDEFINED | UNDEFINED | UNDEFINED | UNDEFINED | UNDEFINED | UNDEFINED |

FIG.13K

PRINTING APPARATUS

This application claims priority from Japanese Patent Application No. 2002-224205 filed Jul. 31, 2002, which is incorporated hereinto by reference.

BACKGROUND OF THE INVENTION

1. Field of the Invention

The present invention relates to a printing apparatus, and more particularly to a printing apparatus for forming images by an electrophotographic process such as a copier or printer.

2. Description of the Related Art

A printing apparatus that makes prints on both sides of a recording medium has been commercialized conventionally from a resource/environmental protection viewpoint. The double-sided printing is implemented using a paper reverse mechanism for inverting a paper after printing its first side, and a paper refeed mechanism for feeding the paper again.

In such a type of printing apparatus, a contrivance is made to effectively carry out double-sided printing by determining the number of sheets of paper waiting on the passage of the paper reverse mechanism and paper refeed mechanism in accordance with the paper size, and by exchanging the printing sequence (refer to Japanese Patent Application Laid-open No. 2002-091102, for example). When the number of sheets of the double-sided printing is large, the printing sequence is changed such that the number of sheets of paper waiting on the passage of the paper reverse mechanism and paper refeed mechanism becomes maximum depending on the paper size. The change of the printing sequence is made by storing print information on a plurality of pages received from a PC (personal computer) into a memory of a printer, and by changing sequences of the pages.

However, when the printer has a small memory capacity, it can store only a small number of pages of the print information, thereby being unable to change page sequence. Accordingly, the small capacity of memory forces to apply a method of printing the first side, followed by reversing the sheet of paper to refeed it and printing the second side corresponding to the back of the sheet, and to repeat the method to conduct the double-sided printing of a plurality of sheets of paper.

In other words, the method keeps only a sheet of paper waiting on the passage of the paper reverse mechanism and paper refeed mechanism. In addition, regardless of the memory size, to carry out the double-sided printing of a sheet of paper, the method is applied of printing the first side, followed by reversing the sheet of paper to refeed it and printing the second side corresponding to the back of the sheet. Furthermore, as for the double-sided printing of reading data by a document reader to make double-sided copy, since it is performed with reading the data by the document reader, it cannot change the order of pages. Accordingly, the method of printing the first side, reversing the sheet of paper to refeed it and printing its second side must be repeated to carry out the double-sided copy of a plurality of sheets of the original document.

The method of printing the first side, reversing the sheet of paper to refeed it and printing its second side, and hence leaving only a sheet of paper on the passage of the paper reverse mechanism and paper refeed mechanism has a problem of prolonging the paper transport duration because of reversing the paper and refeeding it. Thus, a contrivance is made to prevent scraping of an electrophotographic photoconductive body and needless heater driving by halting the charge generation in the electrophotographic process or the heater driving for fixing (refer to Japanese Patent Application Laid-open No. 8-320642 (1996), for example).

In addition, the following contrivance is made of the method of printing the first side, reversing the sheet of paper to refeed it and printing its second side, and hence leaving only a sheet of paper on the passage of the paper reverse mechanism and paper refeed mechanism. When no printing instruction as to the second side is given after completing the printing of the first side, a contrivance is made to continue the printing preparation for a predetermined time period. Thus, even when the printing instruction is delayed a little to develop the printing image of the second side to laser-dot information, the efficiency of the double-sided printing is maintained at a certain level (refer to Japanese Patent Application Laid-open No. 6-019255 (1994), for example).

However, the transport speed of the recording medium is rapidly increasing with the speedup of the printer, thereby sharply shortening the time period of printing the first side, and reversing the sheet of paper to refeed it. Accordingly, the method of printing the first side, reversing the sheet of paper to refeed it and printing its second side, and hence leaving only one sheet of paper on the passage of the paper reverse mechanism and paper refeed mechanism comes to have the following problems. It cannot halt the electrophotographic charge generation during the time from the paper reversal to the refeed as the conventional system does. It cannot halt the rotational driving of the electrophotographic photoconductive body and fixing pressurizing rollers, or can stop them only a very short time even if it can stop them.

In addition, to ease user maintenance of the printer, the life has been prolonged of the electrophotographic photoconductive body and fixing pressurizing rollers, which are replacement parts. The electrophotographic photoconductive body is worn by rotation, and reaches the end of its life by scraping by the charge generation. The fixing pressurizing rollers reaches the end of their life by the worn out because of rotation. Consequently, if the time period is shortened or eliminated of halting the electrophotographic charge generation or halting the rotational driving of the electrophotographic photoconductive body and fixing pressurizing rollers, a problem arises of shortening the life of the electrophotographic photoconductive body and fixing pressurizing rollers.

Furthermore, the method of printing the first side, reversing the sheet of paper to refeed it and printing its second side, and hence leaving only the sheet of paper on the passage of the paper reverse mechanism and paper refeed mechanism has the following problem. Since it makes the contrivance to continue the printing preparation for the predetermined time period when no printing instruction as to the second side is given after completing the printing of the first side, it continues to prepare for the printing of the second side, even when it is not printed. This offers a problem of shortening the life of the electrophotographic photoconductive body and fixing pressurizing rollers, and wasting power.

SUMMARY OF THE INVENTION

Therefore an object of the present invention is to provide a printing apparatus capable of preventing power waste and increasing the life of the electrophotographic photoconductive body and fixing heating roller.

According to the first aspect of the present invention, there is provided a printing apparatus comprising: an image forming section for carrying out image formation on a recording medium using an electrophotographic method; a fixing unit for printing an image by fixing an image on the recording medium thereto by heating and pressurizing the recording medium, which is transported from the image forming section, with a pair of fixing pressurizing rollers; a reversing mechanism for reversing the recording medium having its first side printed with the image, to print an image on a second side of the recording medium; a paper refeed mechanism for refeeding the recording medium reversed by the reversing mechanism; driving means for rotationally driving the image forming section and the fixing pressurizing rollers individually; and control means for temporarily stopping, when printing an image on the second side of the recording medium subsequent to printing the first side of the recording medium, rotational driving of the fixing pressurizing rollers by the driving means after the recording medium passes through the fixing unit and before the second side undergoes printing.

Here, the control means, when printing the second side of the recording medium subsequent to printing the first side of the recording medium, may stop rotational driving of the fixing pressurizing rollers after the recording medium has passed through the fixing unit, carry out paper refeeding after reversing the recording medium, start the image formation of the second side and restart the rotational driving of the fixing pressurizing rollers.

The control means, when printing the second side of the recording medium subsequent to printing the first side of the recording medium, may stop rotational driving of the fixing pressurizing rollers after the recording medium has passed through the fixing unit, carry out paper refeeding after reversing the recording medium, start the image formation of the second side, and restart the rotational driving of the fixing pressurizing rollers previously by a period of time required for the fixing pressurizing rollers to reach a specified rotation speed by the time when the second side arrives at the fixing unit.

The control means, when printing the second side of the recording medium subsequent to printing the first side of the recording medium, may temporarily reduce a high voltage applied to an electrophotographic process after completing the image formation onto the first side of the recording medium.

The control means, when printing the second side of the recording medium subsequent to printing the first side of the recording medium, may reduce a high voltage applied to an electrophotographic process and stops rotational driving of the image forming section after completing the image formation onto the first side of the recording medium, and carry out paper refeeding after reversing the recording medium, restarting of the rotational driving of the image forming section, and raising of the high voltage of the electrophotographic process, the restarting of the rotational driving of the image forming section and the raising of the high voltage being performed previously by a period of time equal to a sum of a rising time of the rotation of the image forming section and a rising time of the high voltage of the electrophotographic process in order to complete the rising of the high voltage of the electrophotographic process by the time when starting an image formation of the second side.

The printing apparatus may further comprise a rotary polygon mirror for exposing the image forming section to light, wherein rotational driving of the rotary polygon mirror may be continued even when rotation of the fixing pressurizing rollers or rotation of the image forming section is halted subsequent to printing the first side of the recording medium and before printing the second side of the recording medium.

The printing apparatus may further comprise heater driving control means for halting heater driving for heating the fixing pressurizing rollers as long as the rotation of the fixing pressurizing rollers is halted, when printing the second side of the recording medium subsequent to printing the first side of the recording medium.

The printing apparatus may further comprise heater driving control means for carrying out heater driving that heats the fixing pressurizing rollers at a first temperature in a standby mode during which printing is not performed, for carrying out heater driving that heats the fixing pressurizing rollers at a second temperature in a printing condition during which printing is performed, and for carrying out heater driving that heats the fixing pressurizing rollers at a third temperature as long as the rotation of the fixing pressurizing rollers is halted, when printing the second side of the recording medium subsequent to printing the first side of the recording medium.

The third temperature may be higher than the first temperature, and lower than or equal to the second temperature.

The fixing unit may consist of a hot roller type fixing unit.

The fixing unit may consist of a film heating type fixing unit.

According to the second aspect of the present invention, there is provided a printing apparatus comprising: an image forming section for carrying out image formation on a recording medium using an electrophotographic method; a fixing unit for printing an image by fixing an image on the recording medium thereto by heating and pressurizing the recording medium, which is transported from the image forming section, with a pair of fixing pressurizing rollers; a reversing mechanism for reversing the recording medium having its first side printed with the image, to print an image on a second side of the recording medium; a paper refeed mechanism for refeeding the recording medium reversed by the reversing mechanism; driving means for rotationally driving the image forming section and the fixing pressurizing rollers individually; print reservation means for reserving a printing operation performed by the image forming section, fixing unit, reversing mechanism and paper refeed mechanism in response to a reservation instruction as to the printing operation specifying a printing condition, and for storing into a memory the printing condition of the printing operation reserved; print control means for carrying out the reserved printing operation under the printing condition stored in the memory; and decision means for making a decision as to whether printing of the second side of the recording medium is carried out subsequent to printing the first side of the recording medium.

The decision means may make a decision, when an image formation of the first side is completed, as to whether printing of the second side of the recording medium is carried out subsequent to printing the first side of the recording medium in accordance with printing condition of a next reserved printing operation.

The decision means may make a decision, when fixing of the first side is completed, as to whether printing of the second side of the recording medium is carried out subsequent to printing the first side of the recording medium in accordance with printing condition of a next reserved printing operation.

The print control means may further carry out: shifting its processing to a standby mode after completing printing of the first side, when no printing condition reserved next to the printing of the first side of the recording medium is present, by dropping the high voltage of the electrophotographic process, by stopping rotational driving of the image forming section, by halting rotational driving of the fixing pressurizing rollers, by reducing the temperature of the heater driving for heating the fixing pressurizing rollers, and by stopping rotational driving of the scanner motor for carrying out scanning of the electrophotographic process; shifting its processing to printing operation of the second side, when a printing condition reserved next to the printing of the first side of the recording medium is associated with the second side of the recording medium, by dropping the high voltage of the electrophotographic process, by stopping rotational driving of the image forming section, by halting rotational driving of the fixing pressurizing rollers, and by reducing the temperature of the heater driving for the fixing, and simultaneously with the refeeding of the second side, by restarting the rotational driving of the image forming section, by raising the high voltage of the electrophotographic process, by restarting the rotational driving of the fixing pressurizing rollers, and by increasing the temperature of the heater driving for the fixing; and shifting its processing to printing operation associated with the next reserved printing condition, when the next reserved printing condition at a time the printing operation of the first side of the recording medium is completed differs from a printing condition of the second side of the recording medium, by dropping the high voltage of the electrophotographic process without stopping the rotational driving of the image forming section.

The print control means may shift, when a printing operation is impossible even though the printing condition reserved next to the printing of the first side of the recording medium is present, its processing to standby mode by dropping the high voltage of the electrophotographic process, by stopping rotational driving of the image forming section, by halting rotational driving of the fixing pressurizing rollers, by reducing the temperature of the heater driving for fixing, and by stopping rotational driving of the scanner motor for carrying out scanning of the electrophotographic process.

The printing apparatus may further comprise heater driving control means for halting heater driving for heating the fixing pressurizing rollers as long as the rotation of the fixing pressurizing rollers is halted, when printing the second side of the recording medium subsequent to printing the first side of the recording medium.

The fixing unit may consist of a hot roller type fixing unit.

The fixing unit may consist of a film heating type fixing unit.

The printing apparatus in accordance with the present invention introduces the print reservation instruction. Thus, it can check a subsequent reservation state at the end of the printing of the first side, and optimize the print sequence. Therefore it can reduce the duration of the high voltage output, the duration of the high temperature of the heater, and the duration of the rotation of the photoconductive drum and that of the fixing pressurizing rollers. In addition, it enables the photoconductive drum and fixing pressurizing rollers to be rotationally driven individually. Thus, it can lengthen the duration of halting the output of the high voltage, the duration of halting the rotation of the photoconductive drum, and the duration of keeping the heater off and the duration of halting the rotation of the fixing pressurizing rollers during the double side transport.

As a result, the printing apparatus can prolong the life of the fixing assembly because of reduction in the duration of the rotation of the fixing rollers. In addition, it can prolong the life of the electrophotographic photoconductive body because of the reduction in the duration of applying the high voltage and the duration of the rotation of the photoconductive drum. Furthermore, it can decrease the power consumption because of the reduction in the duration of the high voltage output, the duration of the high temperature of the heater, and the duration of the rotation of the photoconductive drum and that of the fixing pressurizing rollers.

The above and other objects, effects, features and advantages of the present invention will become more apparent from the following description of embodiments thereof taken in conjunction with the accompanying drawings.

BRIEF DESCRIPTION OF THE DRAWINGS

FIGS. 4A–4G are diagrams showing a print reservation table of the first and second embodiments in accordance with the present invention (double-sided single sheet printing);

FIGS. 5A–5H are diagrams showing a print reservation table of the first and second embodiments in accordance with the present invention (double-sided two sheet printing);

FIGS. 6A–6E are diagrams showing a print reservation table of the first and second embodiments in accordance with the present invention (paper-out condition);

FIGS. 13A–3K are diagrams showing a print reservation table of the third to fifth embodiments in accordance with the present invention;

DETAILED DESCRIPTION OF PREFERRED EMBODIMENTS

The invention will now be described with reference to the accompanying drawings.

(Embodiment 1)

Figure 1:
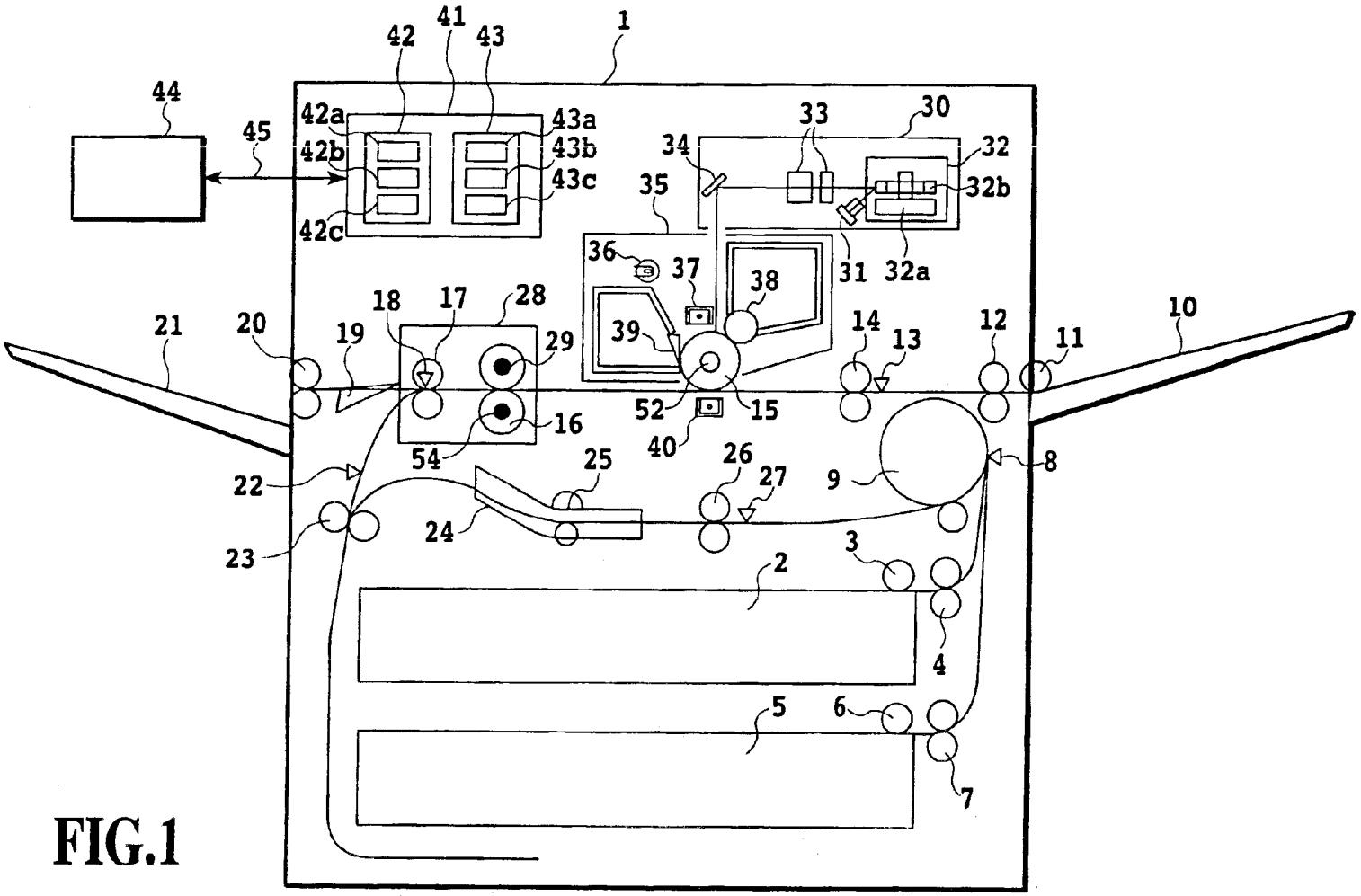
FIG. 1 is a front view showing an arrangement of first, second and third embodiments of a printing apparatus in accordance with the present invention.

FIG. 1 is a front view showing an arrangement of a first embodiment of a printing apparatus in accordance with the present invention by way of example of a laser printer. Incidentally, the present invention is applicable to an image formation apparatus using an intermediate or color image formation apparatus. The present invention is also applicable to printing apparatus that form images by the electrophotographic process such as printers besides copiers.

The main body 1 of the printer includes an upper cassette 2 and a lower cassette 5 for holding recording media. A recording medium is sent out from the upper cassette 2 by an upper pickup feed roller 3, and is conveyed by upper transport rollers 4. In addition, another recording medium is sent out from the lower cassette 5 by a lower pickup feed roller 6, and is conveyed by lower transport rollers 7. The recording medium sent out from the upper cassette 2 or lower cassette 5 is detected by a downstream feed sensor 8, and is further transported by a refeed roller 9.

Another recording medium is sent out from a multi-tray 10 holding the recording media by a multi-pickup feed roller 11, and is conveyed by multi-transport rollers 12. The recording media transported from the upper cassette 2, lower cassette 5 and multi-tray 10 are detected by a downstream register sensor 13, and are halted with leaving a specified loop amount at a pair of register rollers 14. The pair of register rollers 14 restarts the transport of the recording media after establishing the synchronization of the image formation timing (VSYNC signal). A photoconductive drum 15 is driven by a photoconductive drum driving motor 52. At a downstream part of the pair of register rollers 14, a detachable process cartridge 35 is installed for forming a toner image on the photoconductive drum 15 in response to laser light from a laser scanner section 30.

The toner image on the photoconductive drum 15 is transferred onto the recording medium by a transfer charger 40. At a further downstream part, a fixing assembly 28 is installed for heating, pressurizing and fixing the toner image formed on the recording medium. At a downstream part of the fixing assembly 28, are installed a fixed paper discharging sensor 18 for detecting a transport condition and fixing and paper discharge rollers 17 for conveying the recording medium to a paper discharging section. The recording medium is further transported by paper discharging rollers 20 and is output to a paper discharging stack tray 21.

To carry out double sided printing, the recording medium is guided to a reversing mechanical section by a double side flapper 19. The recording medium guided to the reversing mechanism is detected by a reversal sensor 22, and is pulled in by reversing rollers 23. After it has been pulled in completely, the recording medium is reversed by inverting the rotation of the reversing rollers 23, and is guided to a double side transport section. The recording medium led to the double side transport section is carried by cut-off rollers 25, and is stopped at the position at which the notched portion of the cut-off rollers 25 comes into contact with the recording medium. The recording medium is released there and its inclination is corrected by a lateral register adjusting plate 24. Subsequently, the cut-off rollers 25 restarts to transport the recording medium, which is led to downstream double side rollers 26, and its transport position is checked by a double side sensor 27. The refeed roller 9 transports the recording medium to carry out the image formation of the second side.

The laser scanner section 30 comprises a laser unit 31 for emitting laser light modulated in response to an image signal fed from an external apparatus 44, a scanner motor unit 32 for scanning the photoconductive drum 15 with the laser light from the laser unit 31, an image-formation lens set 33, and a folding mirror 34. The scanner motor unit 32 includes a scanner motor 32*a* and a polygon mirror 32*b*. On the other hand, the process cartridge 35 includes the photoconductive drum 15, a pre-exposure lamp 36, a temporary charger 37, a developing unit 38, a transfer charger 40 and a cleaner 39, which are necessary for the electrophotographic process.

A printer control unit 41, which controls the main body 1 of the printer, comprises a video controller 42 and an engine controller 43. The video controller 42 includes a microcomputer 42*a*, a timer 42*b* and a memory 42*c*. The engine controller 43 includes a microcomputer 43*a*, a timer 43*b* and a memory 43*c*. In addition, the printer control unit 41 is communicably connected to an external apparatus 44 such as a host PC via an interface 45.

The main body 1 of the printer further comprises a display/manipulation panel (not shown) for a user to receive various items of information and to carry out selection or setting. The fixing assembly 28 is a hot-roller type fixing unit that comprises a heating-pressurizing roller assembly 16 consisting of a heating roller and pressurizing roller, a heating-pressurizing roller driving motor 54 for driving the heating-pressurizing roller assembly 16, and a heater 29 consisting of a halogen heater and mounted in the heating roller. A temperature detector (not shown) contacting the surface of the heating roller detects the temperature on the surface of the roller to control the temperature at a constant value by turning on and off the heater in response to the detection result. Since the hot roller type fixing unit is the same as that proposed in Japanese Patent Application Laid-open No. 9-146391 (1997), its detailed description is omitted here.

Figure 2:
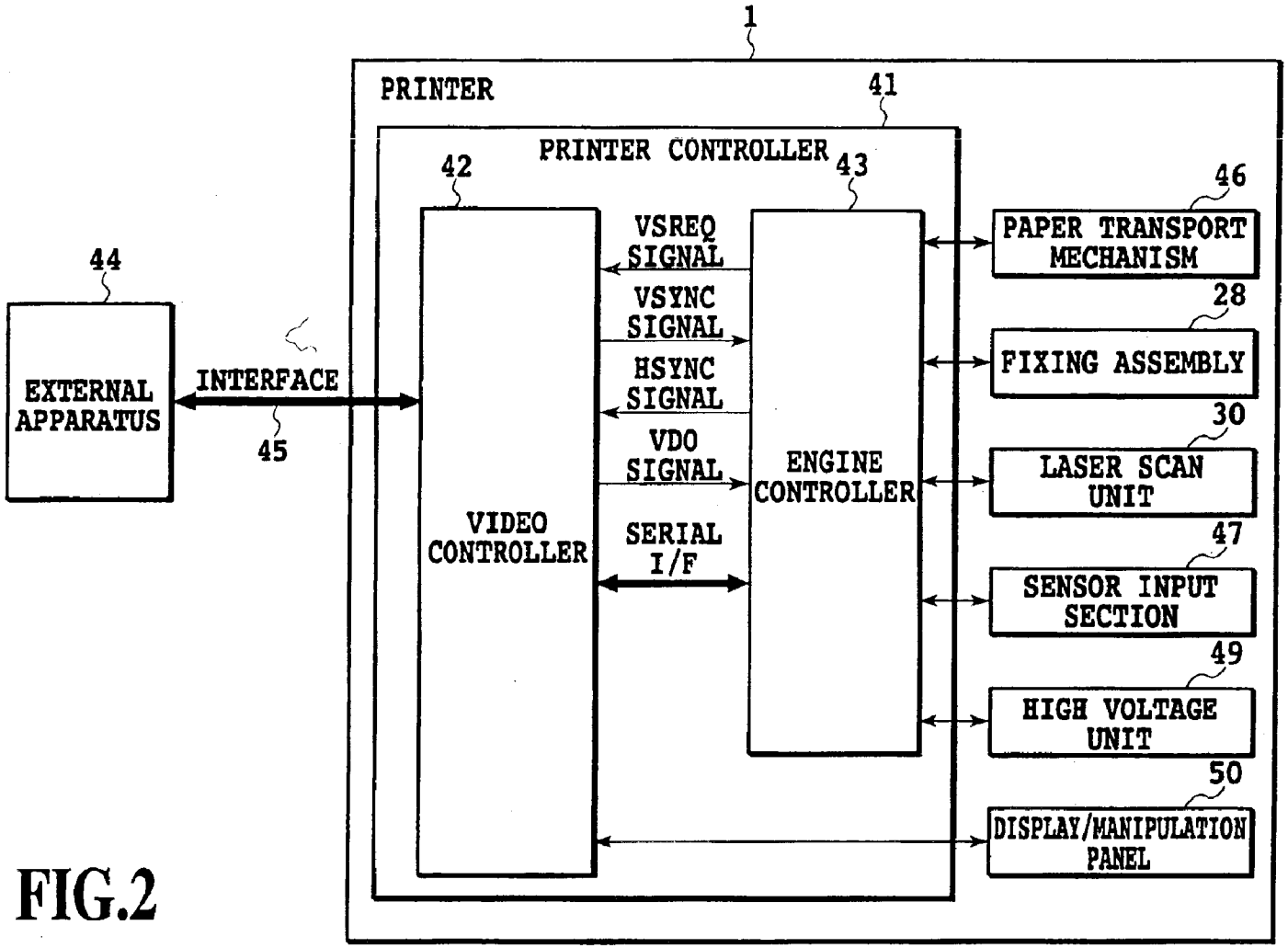
FIG. 2 is a functional block diagram showing a configuration of first to fifth embodiments of the printing apparatus in accordance with the present invention.
Figure 3:
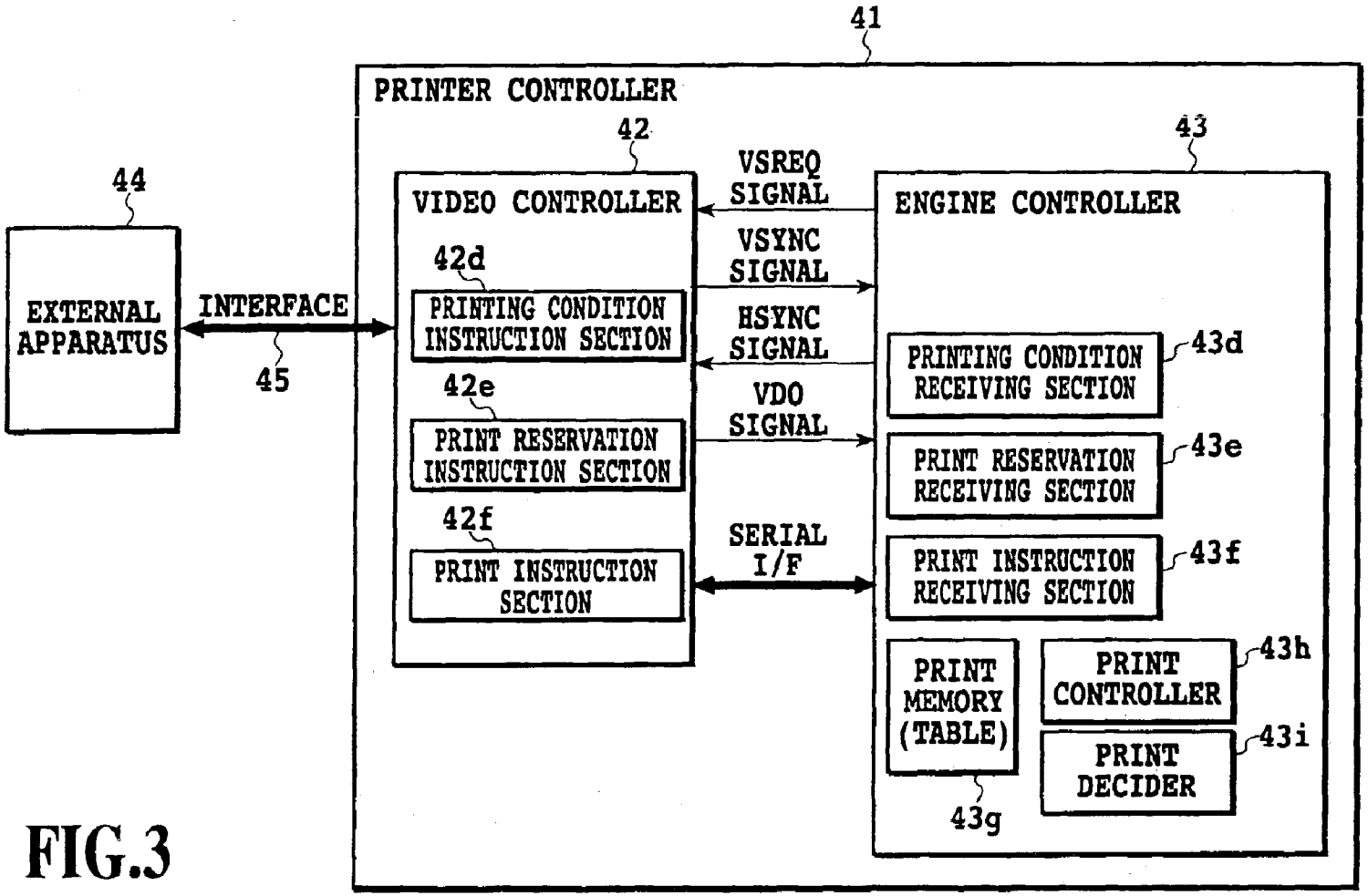
FIG. 3 is a functional block diagram showing the configuration of the first to fifth embodiments of the printing apparatus in accordance with the present invention.

FIGS. 2 and 3 are functional block diagrams showing a configuration of the first embodiment of the printing apparatus in accordance with the present invention. The main body 1 of the printer comprises the printer control unit 41 including the video controller 42 and engine controller 43. The video controller 42 develops the image data sent from the external apparatus 44 such as a host computer via the interface 45 to bit data necessary for printing. The video controller 42 assigns ID to each image to be printed through the engine controller 43 via the serial I/F. In addition, it has a printing condition instruction section 42*d* specify printing conditions such as a paper inlet and a paper outlet, and has a print reservation instruction section 42*e* make a print reservation in accordance with the ID. Furthermore, after completing the development of the bit data, the video controller 42 has a print instruction section 42*f* issue a print instruction to start the image formation.

The engine controller 43 has a printing condition receiving section 43*d* receive the printing conditions instructed by the video controller 42. In addition, it has a print reservation receiving section 43*e* receive the print reservation instructed, and stores the contents of the printing conditions and print reservation in a reservation memory (table) 43*g*.

Thus, the engine controller 43 has a print controller 43*h* control the printing operation, and a decision controller 43*i* switch between various types of control by making a decision as to the reservation conditions. First, according to the notified print reservation, the engine controller 43 controls a paper transport mechanism 46 such as the feed rollers, transport rollers and lifters, thereby feeding a sheet of paper meeting the printing conditions from the paper inlet. Then, according to the print instruction the print instruction receiving section 43*f* receives from the video controller 42 via the serial I/F, the engine controller 43 outputs a vertical sync request signal (VSREQ signal), and waits for a vertical sync signal (VSYNC signal) sent from the video controller 42.

Producing a horizontal sync signal (HSYNC signal) for each line besides the VSYNC signal, the engine controller 43 carries out the image formation with controlling the laser scanner unit 30 in response to a video signal (VDO signal) fed from the video controller 42. Then, the engine controller 43 transfers the image to the paper with a high voltage unit 49, fixes it with the fixing assembly 28, and outputs the paper to the paper outlet specified by the printing conditions by controlling the paper transport mechanism 46.

The video controller 42 displays the printer conditions on the display/manipulation panel 50, and recognizes the contents an operator inputs through the display/manipulation panel 50. The engine controller 43 reads the outputs of various sensors with a sensor input section 47 to detect the presence or absence of a sheet of paper on the transport passage and the like. Incidentally, in the paper transport mechanism 46, the photoconductive drum and fixing pressurizing rollers are driven by the same driving source so that they always rotate simultaneously.

FIGS. 4A–6E are diagrams showing the print reservation table of the first embodiment of the printing apparatus; and FIGS. 7A–9B are time charts illustrating printing of the first embodiment of the printing apparatus. FIGS. 4A–4G correspond to FIGS. 7A–7D, FIGS. 5A–5H correspond to FIGS. 8A and 8B, and FIGS. 6A–6E correspond to FIGS. 9A and 9B, respectively. Referring to these figures, the reservation and print sequence for printing in accordance with the present invention will be described.

First, FIGS. 4A–4G and FIGS. 7A–7D assume to carry out double sided printing of a single sheet of paper through the path from the upper cassette 2 to the paper discharging tray 21. The upper cassette 2 holds at least one sheet of A4-size paper. When the image bit development of the first side of the first sheet has been completed, the video controller 42 assigns the ID number of the first side of the first sheet. Then, it issues the print reservation instruction and print instruction on the printing conditions (ID=4, paper inlet=upper cassette, and paper outlet=double side) to the engine controller 43 via the serial communication.

In response to the print reservation instruction sent from the video controller 42, the engine controller 43 stores the printing conditions (ID number, paper inlet and paper outlet) and the paper size at the reservation into the print reservation table in accordance with the order of the reservation. Then, the upper cassette 2 automatically detects the paper size, and registers A4 as the paper size. In addition, "paper feed waiting" is registered as the mode because the paper feed is not yet carried out, and "no error" is registered as the error.

As a result, the print reservation information on the first side of the first sheet is registered in the print reservation table as illustrated in FIG. 4A. Subsequently, the video controller 42 sends the print reservation instruction on the printing conditions of the second side of the first sheet (ID=4, paper inlet=double side, and paper outlet=paper discharging tray). Since the paper feed is not carried out, the engine controller 43 registers the "paper feed waiting" and "no error". Then, the engine controller 43 starts the print operation of the first sheet because its printing conditions as to ID=4 have been established.

First, the engine controller 43 starts up the scanner by starting the rotation of the scanner motor. In addition, the engine controller 43 starts to rotate the photoconductive drum and fixing pressurizing rollers, raises the high voltage and drives the heater. As for the heater driving, the engine controller 43 switches it from the standby mode of 170° C. temperature regulation to the fixing mode of 190° C. temperature regulation. Then, the engine controller 43 starts the paper feed of ID=4, the initial printing condition. Thus, the engine controller 43 rewrites the mode information on ID=4 of the first side of the first sheet to "paper feeding" as illustrate in FIG. 4B. Since the engine controller 43 has received the print instruction from the video controller 42 when it completes the paper feed, it starts the image formation by exchanging vertical sync signals (VSREQ signal and VSYNC signal). Thus, the engine controller 43 rewrites the mode information on ID=4 of the first side of the first sheet to "printing" as illustrated in FIG. 4C.

The engine controller 43 terminates the printing of the first side of the first sheet when it completes the image formation and fixing, and drops the high voltage of the heater to the 170° C. temperature regulation in the standby mode. In addition, the engine controller 43 halts the rotation of the drum and that of the fixing pressurizing rollers, and waits for the paper to be reversed, double-side transported and conveyed to the paper refeed position. As illustrated in FIG. 4D, the mode information on ID=4 of the first side of the first sheet is rewritten to "double side transporting". In the course of this, the video controller 42 sends to the engine controller 43 the print instruction as to the second side of the first sheet, when the image bit development of the second side of the first sheet has been completed.

When the first side of the first sheet is conveyed to the paper refeed position, the engine controller 43 refeeds the paper as the second side of the first sheet because the paper has been reversed. Thus, the high voltage is started again to place the heater at the 190° C. temperature regulation for fixing after restarting the rotation of the drum and that of the fixing pressurizing rollers. Then, as illustrated in FIG. 4E, the engine controller 43 rewrites the mode information on ID=4 of the second side of the first sheet to "paper feeding", and the mode information on the first side of the first sheet to "second side management" because the print operation is shifted to the second side.

Since the engine controller 43 has received the print instruction from the video controller 42 when it completes the paper refeeding, it exchanges the vertical sync signals (VSREQ signal and VSYNC signal), and starts an image formation. Thus, as illustrated in FIG. 4F, the mode information on ID=4 of the second side of the first sheet is rewritten to "printing". When the engine controller 43 has completed the image formation and the fixing and output, it terminates the printing of the second side of the first sheet. In addition, it drops the high voltage to adjust the heater driving to the standby mode at 170° C. temperature regulation, and stops the rotation of the drum and that of the fixing pressurizing rollers and the rotation of the scanner motor. When the second side of the first sheet is output, the engine controller 43 deletes the reservation information on the first side and second side of the first sheet of ID=4 to clear all the conditions to no reservation as illustrated in FIG. 4G.

Figure 7A:
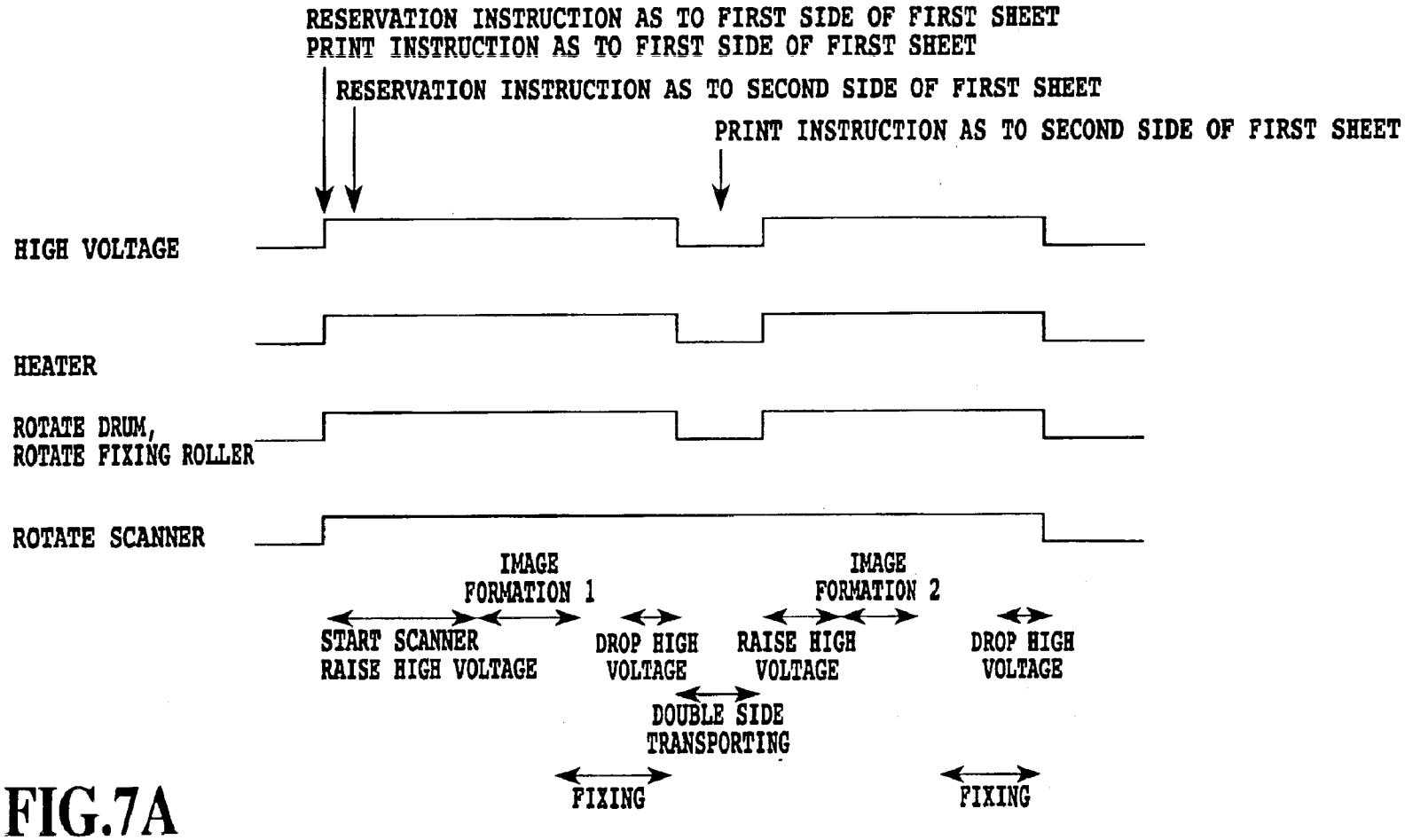
FIGS. 7A–7D are time charts illustrating printing of the first and second embodiments in accordance with the present invention (double-sided single sheet printing)

Let us ensure the foregoing operation in the time chart of the printing as illustrated in FIG. 7A. First, the engine controller 43 starts the rotation of the scanner and the rotation of the drum and that of the fixing pressurizing rollers, raises the high voltage, and switches the heater driving from the standby mode at 170° C. temperature regulation to the fixing mode of 190° C. temperature regulation. After completing various start-ups and paper feed, the engine controller 43 carries out the image formation of the first side of the first sheet, and the fixing with reducing the high voltage. After the fixing, starting the double side transport which reverses the paper and conveys it to the paper refeeding position, the engine controller 43 switches the heater driving from the 190° C. temperature regulation to 170° C. temperature regulation, and stops the rotation of the photoconductive drum and that of the fixing pressurizing rollers.

Subsequently, when the first side of the first sheet is transported to paper refeeding position, the engine controller 43 restarts the rotation of the photoconductive drum and that of the fixing pressurizing rollers, switches the heater from the 170° C. temperature regulation to the 190° C. temperature regulation, raises the high voltage, and starts the paper refeeding as the second side of the first sheet. After completing raising the high voltage and paper refeeding, the engine controller 43 carries out the image formation of the second side of the first sheet, fixes it, and drops the high voltage with outputting the fixed paper. Then, as the sheet is being output, the engine controller 43 switches the heater driving from the 190° C. temperature regulation to the 170° C. temperature regulation, and stops the rotation of the drum and that of the fixing pressurizing rollers and the rotation of the scanner motor.

Figure 7B:
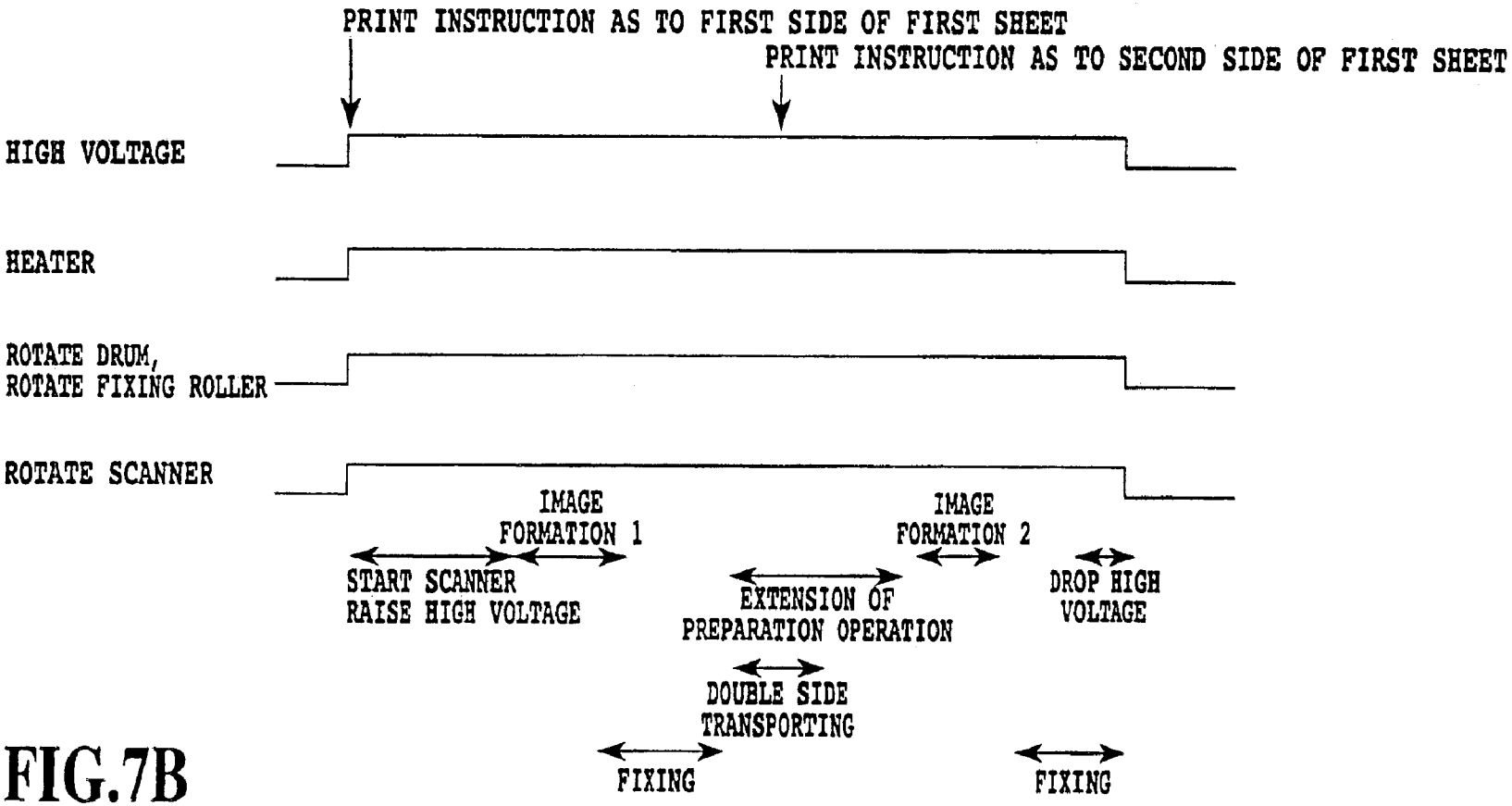
FIG.7B PRIOR ART

On the other hand, FIG. 7B is a time chart of the printing by a conventional example. As disclosed in Japanese Patent Application Laid-open No. 6-019255 (1994), the method makes the following contrivance when a printing instruction as to the second side does not arrive after completing the printing of the first side of a sheet, in the method of printing the first side, reversing the sheet to refeed it, and then printing the second side. Specifically, it continues print preparation operation for a predetermined time period so that it can prevent the efficiency of the double-sided printing from being impaired even if the printing instruction is delayed to some extent because of the time required to develop the print image of the second side to the laser dot information.

The conventional example has an extension period for the preparation operation even during the double side transport. Thus, it can continue the print operation of the second side within the extension period of the preparation operation even if the image dot development of the second side of the first sheet takes some extra time. Since the conventional example has no print reservation instruction, it arranges the print sequence using only the print instruction sent to the engine controller 43 every time the image dot development has been completed. Therefore, considering the possibility that the image dot development of the second side takes some extra time after printing the first side, the conventional example makes the contrivance to continue the printing based on the print instruction as to the second side for the extension period of the preparation operation of the predetermined time period.

In contrast, according to the present invention, before the image dot development, the engine controller 43 is notified of the print reservation instruction that the second side is to be printed. Accordingly, it can arrange the print sequence based on the print reservation instruction. Hence, it can learn from the print reservation instruction as to the second side that the printing of the second side will follow even if the print instruction as to the second side does not arrive.

Thus, it becomes unnecessary to extend the preparation operation to maintain the print throughput. In addition, since the time is available during the double side transport of the first side and second side, the engine controller 43 can drop the temperature of the heater by halting the supply of the high voltage after completing the printing of the first side, and can stop the rotation of the drum and that of the fixing pressurizing rollers. Then, after completing the double side transport of the first side, the engine controller 43 carries out the refeeding and printing of the second side by restarting the rotation, by raising the high voltage and by elevating the heater temperature. As a result, as compared with the conventional example of FIG. 7B, the printer in accordance with the present invention as shown in FIG. 7A can enable the following operations with maintaining the throughput of the double-sided printing. Specifically, it can stop the output of the high voltage, reduce the heater temperature, and provide the halting time of the rotation of the photoconductive drum and that of the fixing pressurizing rollers during the double side transport.

Figure 7C:
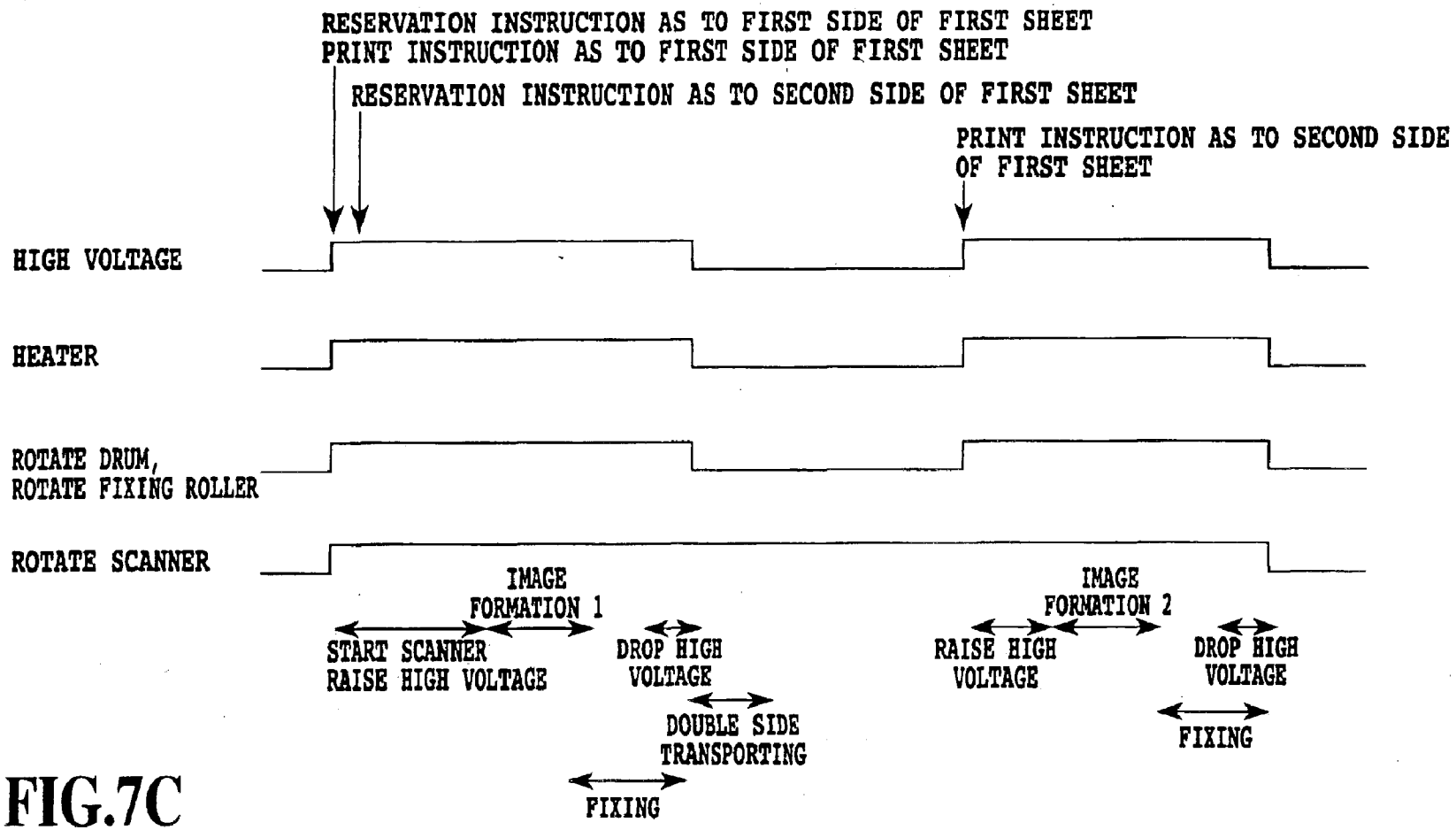
Figure 7D:
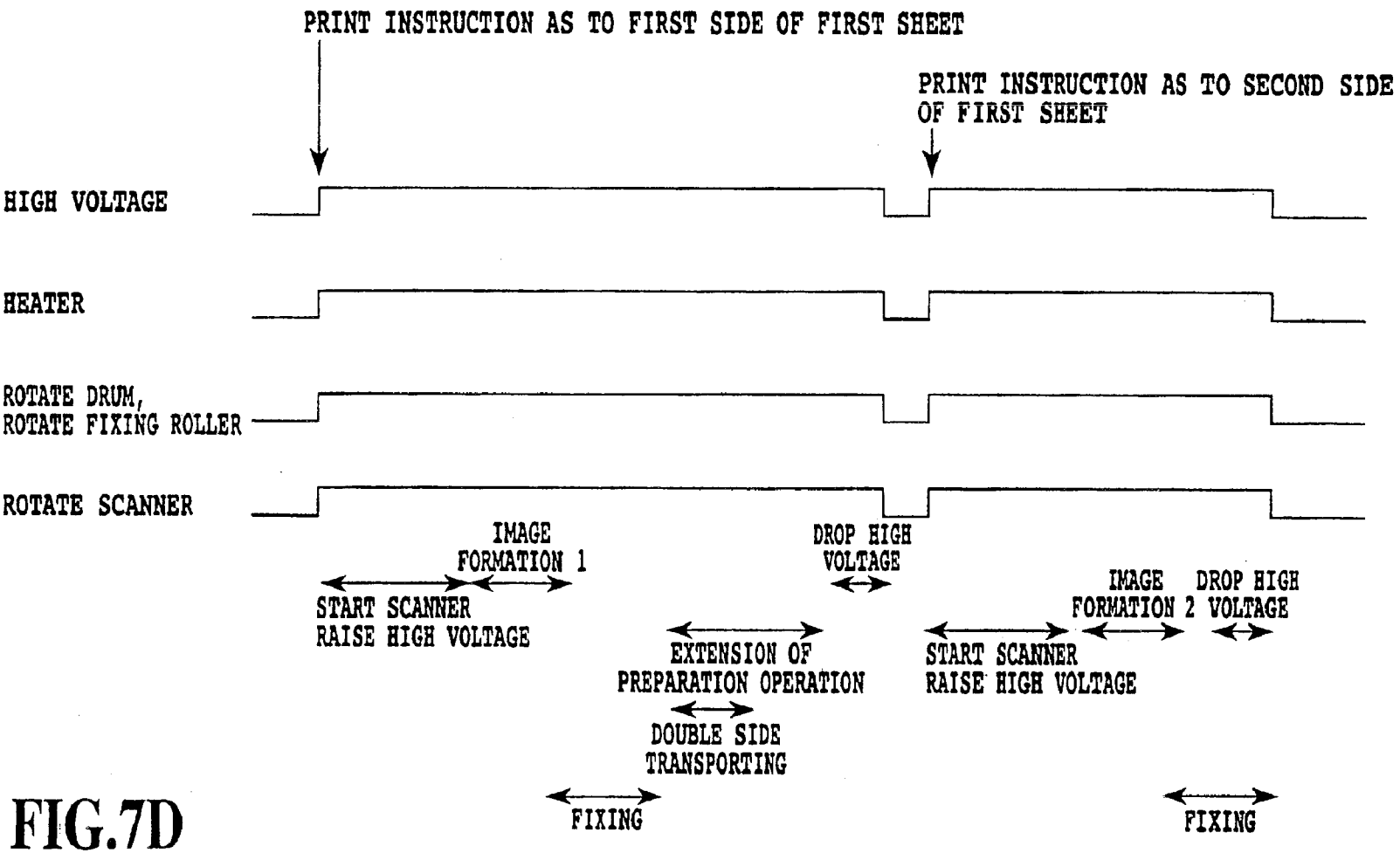
FIG.7D PRIOR ART

Let us compare cases where the image dot development of the second side takes more time than the foregoing case. FIG. 7C is a time chart illustrating printing operation in accordance with the present invention; and FIG. 7D is a time chart illustrating printing operation of the conventional example. In the foregoing case, the print instruction as to the second side is output when the image dot development of the second side has been completed during the double side transport of the first side. In the present case, it is not until the end of the image development, which is completed at length after some time has elapsed from the time when the sheet arrives at the paper refeed position after completing the double side transport of the first side, that the print instruction as to the second side is output.

According to the present invention illustrated in FIG. 7C, the reservation instruction as to the second side indicates that the print instruction as to the second side is sure to come. Thus, as soon as the printing of the first side has been completed, the printer waits for the instruction with stopping the output of the high voltage, reducing the heater temperature, and halting the rotation of the photoconductive drum and that of the fixing pressurizing rollers. Then, in response to the print instruction as to the second side, the printer restarts the rotation of the photoconductive drum and that of the fixing pressurizing rollers, increases the temperature of the heater, and raises the high voltage to carry out the print operation of the second side.

In the conventional example as illustrated in FIG. 7D, the print instruction as to the second side does not arrive during the extension period of the preparation operation. Accordingly, the high voltage is dropped, the temperature of the heater is reduced, and the rotation of the photoconductive drum and that of the fixing pressurizing rollers and the rotation of the scanner motor are stopped. Then, in response to the print instruction as to the second side, the printer restarts the rotation of the scanner and the rotation of the photoconductive drum and that of the fixing pressurizing rollers, increases the temperature of the heater, and raises the high voltage, thereby entering the print operation of the second side. However, since the startup of the scanner takes a considerable time, the conventional example unavoidably delays the printing of the second side. In contrast, the printer in accordance with the present invention knows that the print instruction as to the second side is sure to come when it has received the reservation instruction as to the second side. Thus, it can continue the rotation of the scanner, thereby being able to prevent the delay of the printing of the second side.

Furthermore, compared with the conventional example as shown in FIG. 7D, the embodiment in accordance with the present invention as shown in FIG. 7C can prolong the following durations during the double side transport: the duration of halting the output of the high voltage; the duration of reducing the heater temperature; and the duration of stopping the rotation of the photoconductive drum and that of the fixing pressurizing rollers.

Next, FIGS. 5A–5H and FIGS. 8A and 8B assume that double sided printing of two sheets of paper is made on the path from the upper cassette 2 to the paper discharging tray 21. The upper cassette 2 holds at least two sheets of A4-size paper. The two sheet double sided printing is carried out through alternate paper feed sequence: two sheets of paper are present on the double side transport passage from the reverse transport passage to the paper refeeding in such a sequence as the first side of the first sheet, the first side of the second sheet, the second side of the first sheet and the second side of the second sheet. In this way, the method can improve the throughput of the double-sided printing.

When the image bit development of the first side of the first sheet has been completed, the video controller 42 assigns the ID number of the first side of the first sheet, and issues the print reservation instruction and print instruction on the printing conditions (ID=4, paper inlet=upper cassette and paper outlet=double side) to the engine controller 43 via the serial communication. The engine controller 43 registers them as the "paper feed waiting" so that the print reservation information on the first side of the first sheet is registered in the print reservation table as illustrated in FIG. 5A.

Subsequently, the video controller 42 issues the print reservation instructions with the printing conditions of the first side of the second sheet (ID=7, paper inlet=upper cassette, and paper outlet=double side), printing conditions of the second side of the first sheet (ID=4, paper inlet=double side, and paper outlet=paper discharging tray), and printing conditions of the second side of the second sheet (ID=7, paper inlet=double side, and paper outlet=paper discharging tray). The engine controller 43 registers them in the print reservation table as the "paper feed waiting" mode. Then, the engine controller 43 starts the print operation of the first side of the first sheet because the printing conditions as to ID=4 have been completed.

First, the engine controller 43 starts the rotation of the scanner motor to start up the scanner, starts the rotation of the photoconductive drum and that of the fixing pressurizing rollers, and starts the heater driving by raising the high voltage. The heater driving is switched from the standby mode of the 170° C. temperature regulation to the 190° C. temperature regulation for fixing. Then, as to the ID=4, the first printing condition, the engine controller 43 starts the paper feed, and rewrites the mode information on ID=4 of the first side of the first sheet to "paper feeding" as illustrated in FIG. 5B. Since the engine controller 43 has already received the print instruction from the video controller 42 when it completes the paper feed, it starts the image formation. In addition, it starts the paper feed of the first side of the second sheet, which is also possible.

Thus, as illustrated in FIG. 5C, the engine controller 43 rewrites the mode information on ID=4 of the first side of the first sheet to "printing", and the mode information on ID=7 of the second side of the second sheet into "paper feeding".

The engine controller 43 brings the printing of the first side of the first sheet to an end when the image formation and fixing are completed. Then, the engine controller 43 reverses the sheet and waits for the sheet to be conveyed to the paper refeed position by the double side transport. At the same time, since the engine controller 43 has also received the print instruction on the first side of the second sheet, it starts its image formation. As illustrated in FIG. 5D, the engine controller 43 rewrites the mode information on ID=4 of the first side of the first sheet to "double side transporting", and the mode information on ID=7 of the first side of the second sheet to "printing". The engine controller 43 completes the printing of the first side of the second sheet, and moves to the double side transport after reversing the paper. When the first side of the first sheet is conveyed to the paper refeed position, the engine controller 43 refeeds the paper as the second side of the first sheet because the paper has been reversed. As illustrated in FIG. 5E, the engine controller 43 rewrites the mode information on ID=4 of the second side of the first sheet to "paper feeding". In addition, the engine controller 43 rewrites the mode information on the first side of the second sheet to "second side management" because the print operation is shifted from the first side to the second side of the first sheet. Moreover it rewrites the mode information on the first side of the second sheet to "double side transporting".

Since the engine controller 43 has already received the print instruction from the video controller 42 when it completes the paper refeeding, it starts an image formation. As for the first side of the second sheet, since the double side transport has been completed, it is refeed as the second side of the second sheet. Thus, as illustrated in FIG. 5F, the mode information on ID=4 of the second side of the first sheet is rewritten to "printing", and the mode information on ID=7 of the second side of the second sheet is rewritten to "paper feeding". In addition, the mode information on ID=7 of the first side of the second sheet is rewritten to "second side management".

When the engine controller 43 has completed the image formation and fixing and output, it terminates the printing of the second side of the first sheet. In addition, since the engine controller 43 has already received the print instruction as to the second side of the second sheet, it starts the image formation. As illustrated in FIG. 5G, the engine controller 43 deletes the information on ID=4 of the first side and second side of the first sheet, and rewrites the mode information on the second side of the second sheet to "printing". When the printing of the second side of the second sheet has been completed, the engine controller 43 drops the high voltage, places the heater driving in the standby mode at 170° C. temperature regulation, and stops the rotation of the photoconductive drum and that of the fixing pressurizing rollers and the rotation of the scanner motor. When the second side of the first sheet is output, the engine controller 43 deletes the reservation information on ID=7 of the first side and second side of the second sheet so that all the conditions are cleared to no reservation as illustrated in FIG. 5H.

Figure 8A:
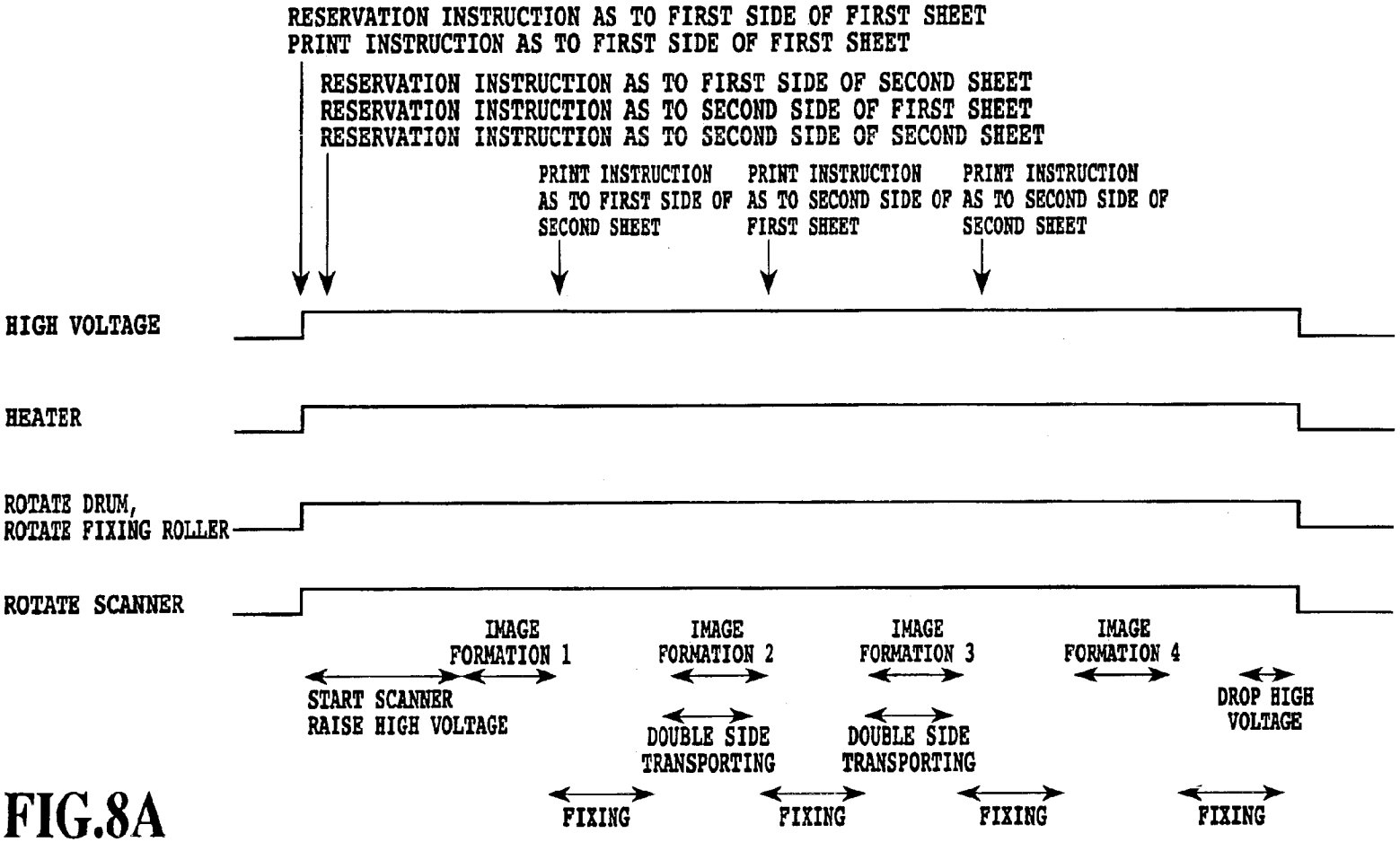
FIGS. 8A and 8B are time charts illustrating printing of the first and second embodiments in accordance with the present invention (double-sided two sheet printing)

Let us ensure the foregoing operation in the time chart of the printing as illustrated in FIG. 8A. First, the engine controller 43 starts the rotation of the scanner and the rotation of the photoconductive drum and that of the fixing pressurizing rollers, raises the high voltage, and switches the heater driving from the standby mode at 170° C. temperature regulation to the fixing mode of 190° C. temperature regulation. After completing various start-ups and paper feed, the engine controller 43 carries out the image formation of the first side of the first sheet, and the paper feed of the first side of the second sheet. After fixing the first side of the first sheet, the engine controller 43 starts the double side transport, which reverses the sheet and conveys it to the paper refeeding position. Subsequently, the engine controller 43 completes the paper feed of the first side of the second sheet and carries out the image formation. Then, the engine controller 43 fixes the first side of the second sheet, followed by the double side transport, and restarts the paper refeeding of the second side of the first sheet when the first side of the first sheet arrives at the paper refeed position.

After completing the paper refeeding, the engine controller 43 carries out the image formation of the second side of the first sheet, and starts the paper refeeding of the second side of the second sheet when the first side of the second sheet arrives at the paper refeed position. Then, during the paper discharging after fixing the second side of the first sheet, the engine controller 43 completes the paper refeeding of the second side of the second sheet and starts the image formation. Then, it fixes the second side of the second sheet followed by the output, switches the heater from the 190° C. temperature regulation to the 170° C. temperature regulation, and stops the rotation of the photoconductive drum and that of the fixing pressurizing rollers and the rotation of the scanner motor.

Figure 8B:
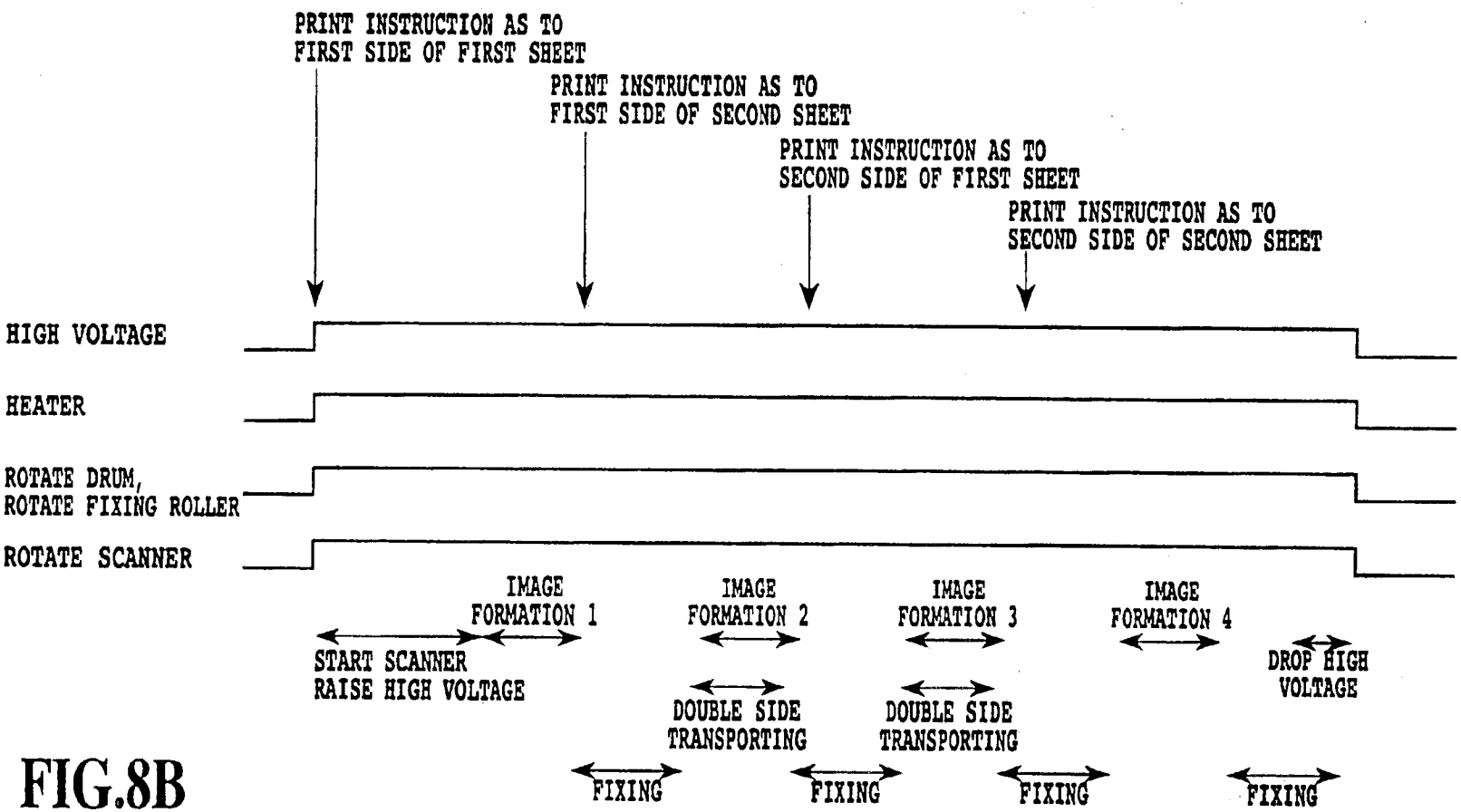
FIG.8B PRIOR ART

FIG. 8B is a time chart illustrating printing in the conventional example. Since it assumes that the image development is completed in a short time, and the print instruction is output successively, the conventional example as shown in FIG. 8B does not differ from the embodiment in accordance with the present invention as shown in FIG. 8A in the double side alternate paper feed sequence.

Finally, FIGS. 6A–6E and FIGS. 9A and 9B assume that double sided printing of two sheets of paper is made on the path from the upper cassette 2 to the paper discharging tray 21. The two sheet double sided printing is carried out through alternate paper feed sequence: two sheets of paper are present on the double side transport passage from the reverse transport passage to the paper refeeding in such a sequence as the first side of the first sheet, the first side of the second sheet, the second side of the first sheet and the second side of the second sheet. In this way, the method can improve the throughput of the double-sided printing. It is further assumed here that the upper cassette 2 holds only one sheet of A4-size paper, so that the printing is interrupted in the course of printing because of paper-out condition.

When the image bit development of the first side of the first sheet has been completed, the video controller 42 assigns the ID number of the first side of the first sheet, and issues the print reservation instruction and print instruction on the printing conditions (ID=4, paper inlet=upper cassette, and paper outlet=double side) to the engine controller 43 via the serial communication. The engine controller 43 registers them as the "paper feed waiting" so that the print reservation information on the first side of the first sheet is registered in the print reservation table as illustrated in FIG. 6A.

Subsequently, the video controller 42 issues the print reservation instructions with the printing conditions of the first side of the second sheet (ID=7, paper inlet=upper cassette, and paper outlet=double side), printing conditions of the second side of the first sheet (ID=4, paper inlet=double side, and paper outlet=paper discharging tray), and printing conditions of the second side of the second sheet (ID=7, paper inlet=double side, and paper outlet=paper discharging tray). The engine controller 43 registers them in the print reservation table as the "paper feed waiting" mode. Then, the engine controller 43 starts the print operation of the first side of the first sheet because the printing conditions as to ID=4 have been completed.

First, the engine controller 43 starts the rotation of the scanner motor to start up the scanner, starts the rotation of the photoconductive drum and that of the fixing pressurizing rollers, and starts the heater driving by raising the high voltage. The heater driving is switched from the standby mode of the 170° C. temperature regulation to the 190° C. temperature regulation for fixing. Then, as to the ID=4, the first printing condition, the engine controller 43 starts the paper feed, and rewrites the mode information on ID=4 on the first side of the first sheet to "paper feeding" as illustrated in FIG. 6B.

Since the engine controller 43 has already received the print instruction from the video controller 42 when it completes the paper feed, it starts the image formation. At the same time, although it is the time to start the paper feed of the first side of the second sheet, the operation is impossible because of the paper-out condition. This is because the upper cassette held only one sheet of paper. Thus, as illustrated in FIG. 6C, the engine controller 43 rewrites the mode information on ID=4 of the first side of the first sheet to "printing", and the error information on ID=7 of the first side of the second sheet into "paper-out error".

The engine controller 43 brings the printing of the first side of the first sheet to an end when the image formation and fixing are completed. Then, because there is no reservation enabling the next print operation, the engine controller 43 drops the high voltage, places the heater driving at the 170° C. temperature regulation as in the standby mode, halts the rotation of the photoconductive drum and that of the fixing pressurizing rollers, and the rotation of the scanner motor. Subsequently, the engine controller 43 reverses the sheet and waits for the sheet to be conveyed to the paper refeed position by the double side transport. As illustrated in FIG. 6D, the engine controller 43 rewrites the mode information on ID=4 of the first side of the first sheet to "double side transporting". Although the engine controller 43 is expected to refeed the first side of the first sheet as the second side of the first sheet when the sheet arrives at the paper refeed position, it enters into the standby mode because the first side of the second sheet which has higher priority is in the "paper-out error" state. As illustrated in FIG. 6E, the engine controller 43 rewrites the mode information on the first side of the first sheet to "second side management", and waits for the next sheet to be inserted to the upper cassette and the "paper-out error" condition to be released.

Figure 9A:
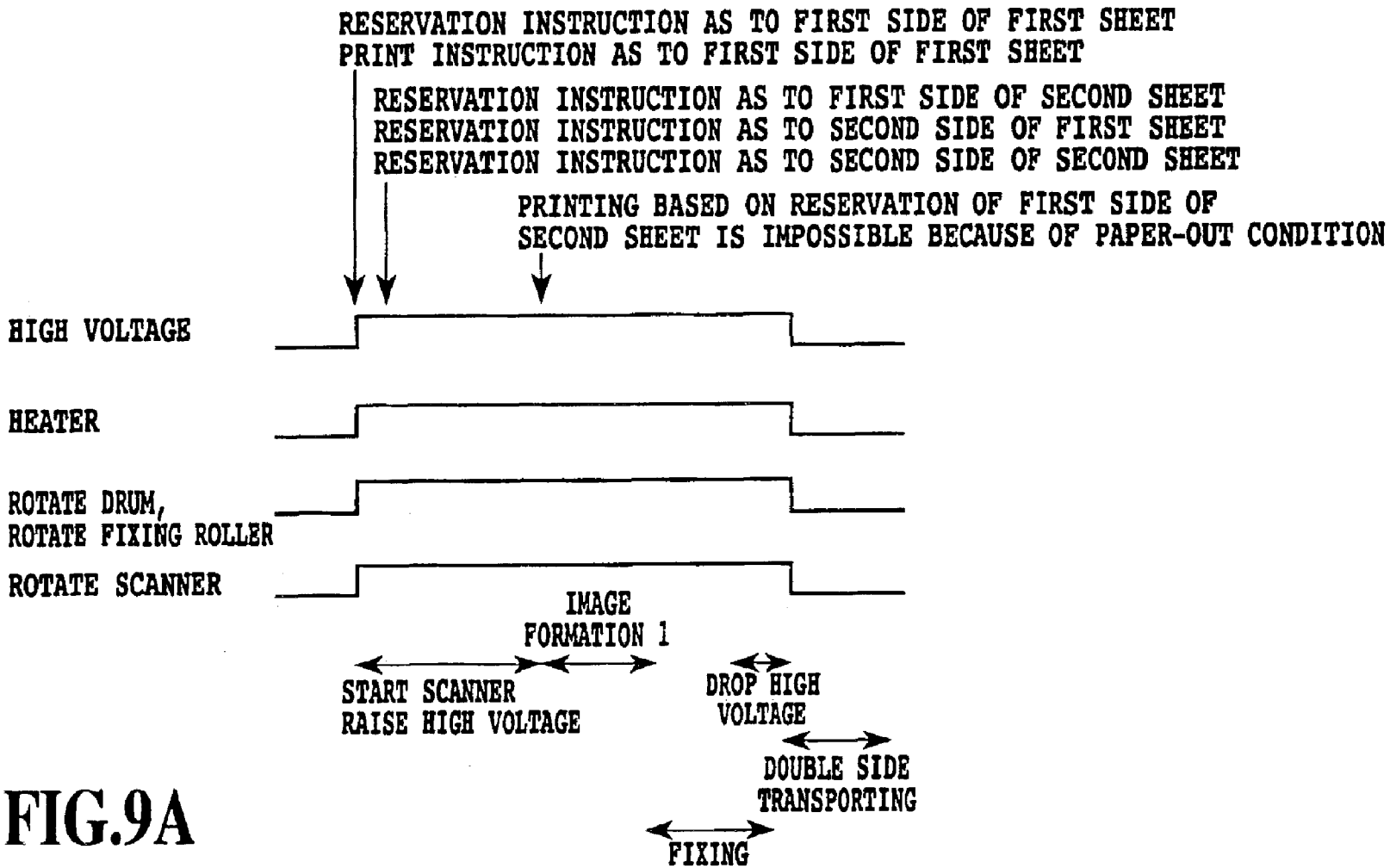
FIGS. 9A and 9B are time charts illustrating printing of the first and second embodiments in accordance with the present invention (paper-out condition)

Let us ensure the foregoing operation in the time chart of the printing as illustrated in FIG. 9A. First, the engine controller 43 starts the rotation of the scanner and the rotation of the photoconductive drum and that of the fixing pressurizing rollers, raises the high voltage, and switches the heater driving from the standby mode at 170° C. temperature regulation to the fixing mode at 190° C. temperature regulation. After completing various start-ups and paper feed, the engine controller 43 carries out the image formation of the first side of the first sheet. As for the first side of the second sheet, the print operation is impossible because of the "paper-out error" because the upper cassette holds no sheet of paper. The engine controller 43 fixes the first side of the first sheet, and enables the double side transport which reverses the sheet and conveys it to the paper refeeding position. Subsequently, the engine controller 43 switches the heater driving from the 190° C. temperature regulation to the 170° C. temperature regulation, halts the rotation of the photoconductive drum and that of the fixing pressurizing rollers and the rotation of the scanner motor, because there is no reservation enabling the next print operation. Then, the engine controller 43 waits for the paper for the first side of the second sheet to be supplied to the upper cassette when the first side of the first sheet is conveyed to the paper refeed position.

Figure 9B:
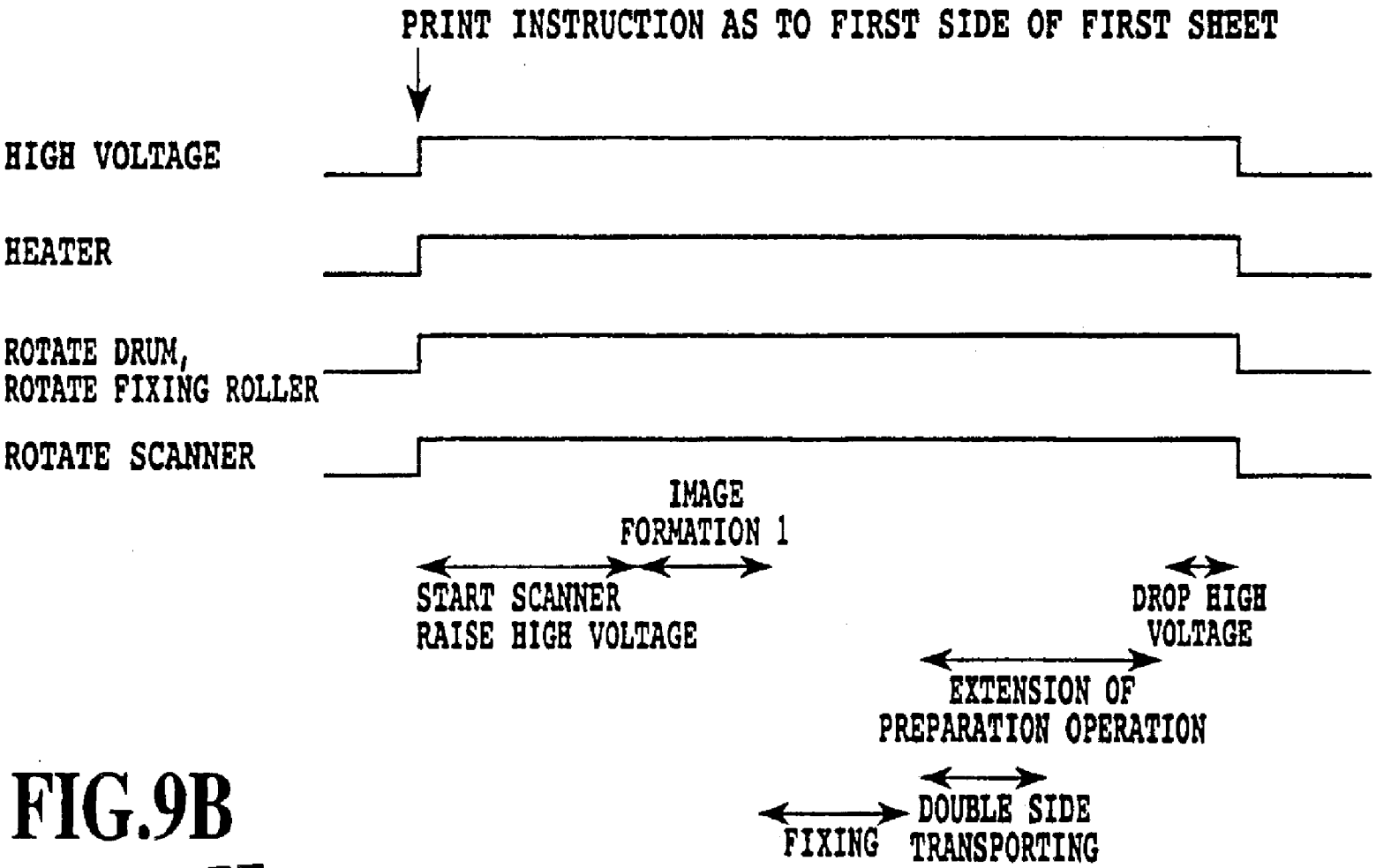
FIG.9B PRIOR ART

FIG. 9B is a time chart of the printing by the conventional example. After completing the printing of the first side of the first sheet, the print instruction as to the first side of the second sheet is not delivered because the upper cassette is out of paper and hence in the "paper-out" condition. However, the engine controller 43 extends the preparation operation after the first side, and after extending a predetermined time period, it switches the heater driving from the 190° C. temperature regulation to the 170° C. temperature regulation, and halts the rotation of the photoconductive drum and that of the fixing pressurizing rollers and the rotation of the scanner motor. Therefore the shift to the standby mode is delayed by the period of time taken by the preparation operation extension.

In contrast with this, the present embodiment in accordance with the present invention can speed up the shift to the standby mode. This is because it has the print reservation instruction, and hence can check in advance when completing the printing of the first side whether the printing of the second sheet is continued or interrupted from the presence or absence of the print reservation. As clearly seen by comparing the conventional example of FIG. 9B with the embodiment in accordance with the present invention as shown in FIG. 9A, the present embodiment can reduce the duration of the high voltage output, the duration of the high temperature of the heater, and the duration of the rotation of the photoconductive drum and that of the fixing pressurizing rollers.

Figure 10:
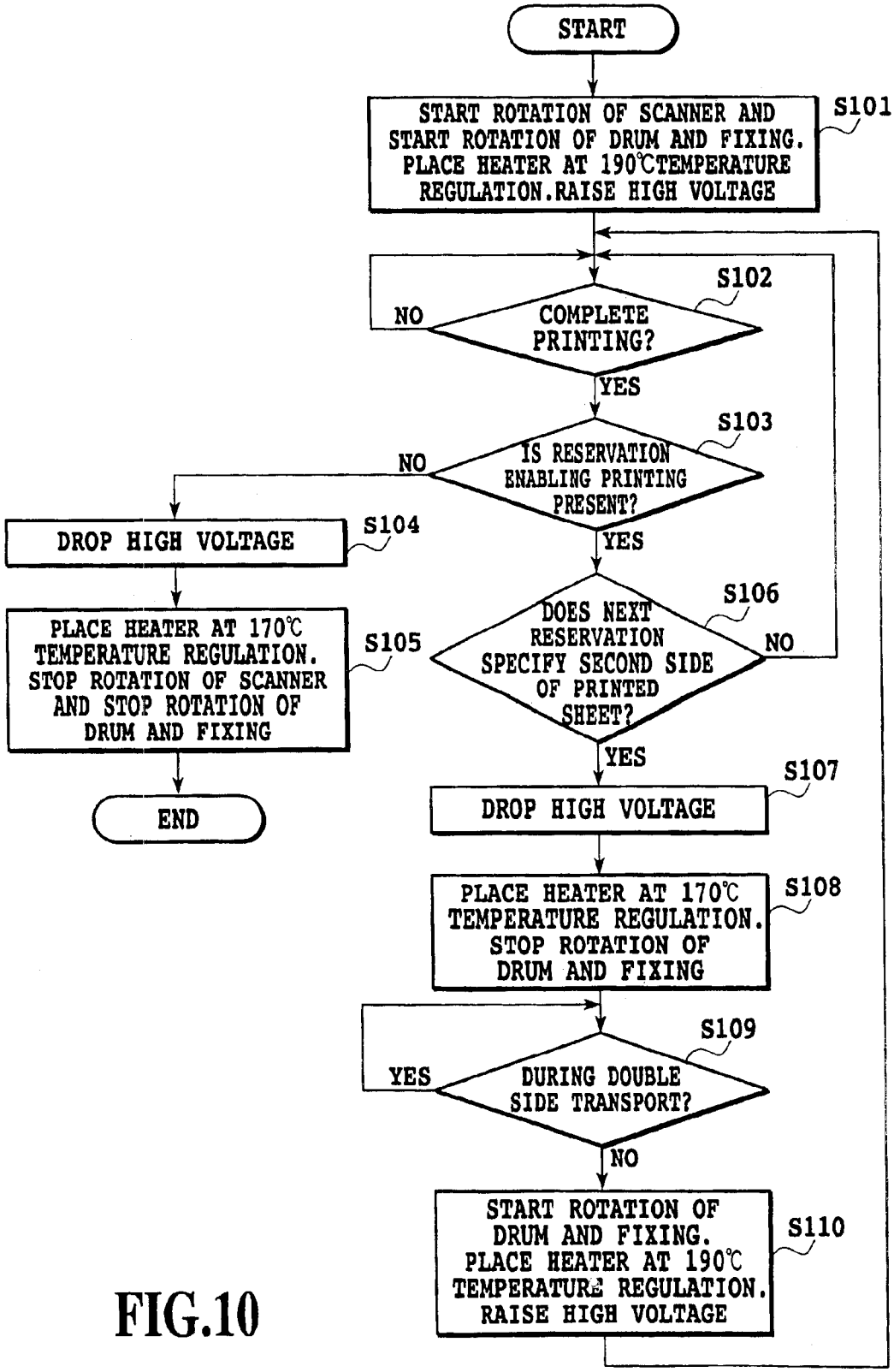
FIG. 10 is a flowchart illustrating the printing control of the controller of the first embodiment in accordance with the present invention.

FIG. 10 is a flowchart illustrating the procedure of the printing operation of the engine controller 43 in the first embodiment of the printing apparatus. According to the print reservation instruction and print instruction enabling the print operation, the engine controller 43 starts the printing operation. First, the engine controller 43 starts the rotation of the scanner motor and the rotation of the drum and that of the fixing pressurizing rollers, switches the heater driving to the 190° C. temperature regulation, and starts up the high voltage at step S101. Then, the engine controller 43 waits for the first printing to be completed step S102. When the printing has been completed, the engine controller 43 checks whether the print reservation enabling the next printing is present or not at step S103. If it is not present, the engine controller 43 drops the high voltage at step S104.

In addition, it switches the heater to the 170° C. temperature regulation, and halts the rotation of the drum and that of the fixing pressurizing rollers and the rotation of the scanner motor at step S105, thereby terminating the printing operation. When the print reservation enabling the next printing is present after completing the printing, the engine controller 43 checks whether the next reservation is the reservation of the second side of the printed sheet at step S106. If it is not the reservation of the second side of the printed sheet, the engine controller 43 carries out the printing of the next reservation, and returns the processing to step S102. On the other hand, if it is the reservation of the second side of the printed sheet, the engine controller 43 drops the high voltage at step S107. Then, it places the heater at 170° C. temperature regulation, and halts the rotation of the photoconductive drum and that of the fixing pressurizing rollers at step S108.

After that, the engine controller 43 waits for the double side transport to be completed which reverses the sheet of the first side and conveys it to the paper refeed position at step S109. When the double side transport has been completed, the engine controller 43 restarts the rotation of the photoconductive drum and that of the fixing pressurizing rollers, brings the heater into the 190° C. temperature regulation and sets up the high voltage at step S110. Then, it carries out the printing of the second side, and returns the processing to step S102.

As described above, introducing the print reservation instruction enables the engine controller 43 to make a decision, at the completion of the printing of the first side, as to whether the printing of the second side is scheduled following the printing of the first side, or as to whether the printing is planned after the printing of the first side, or the printing is interrupted or not. In addition, the engine controller 43 can confirm the subsequent reservation state at the end of the printing of the first side, and optimize the print sequence. Thus, it can obviate the need for the control of continuing the preparation operation after completing the printing of the first side to maintain the throughput of the double-sided printing, which is necessary in the conventional printer.

In addition, confirming the subsequent reservation state, the engine controller 43 can arrange an optimum print sequence. For example, when the printing next to the first side is the second side of the same sheet in the double-sided printing, the engine controller 43 can take the following actions with maintaining the throughput of the double-sided printing. Specifically, utilizing the time period during which the first side of the sheet is reversed and conveyed to the paper refeeding position by the double side transport, the engine controller 43 can secure the duration of halting the output of the high voltage, the duration of the low temperature of the heater, and the duration of halting the rotation of the photoconductive drum and that of the fixing pressurizing rollers, or can prolong such a time.

In addition, when the printing following the first side is interrupted or absent, the engine controller 43 can immediately halt the output of the high voltage, reduce the temperature of the heater, and stop the rotation of the photoconductive drum and that of the fixing pressurizing rollers without continuing the preparation operation. As a result, the present embodiment can reduce the rotation time of the fixing roller without any means for continuing the preparation operation with maintaining the throughput of the double-sided printing, thereby being able to prolong the life of the fixing assembly. Furthermore, since it can reduce the time of applying the high voltage and the time of rotating the photoconductive drum, it can prolong the life of the electrophotographic photoconductive body. Moreover, since it can shorten the duration of keeping the temperature of the heater high, the duration of applying the high voltage, and the duration of rotating the photoconductive drum and fixing pressurizing rollers, it can reduce the power consumption.

Second Embodiment

Figure 11:
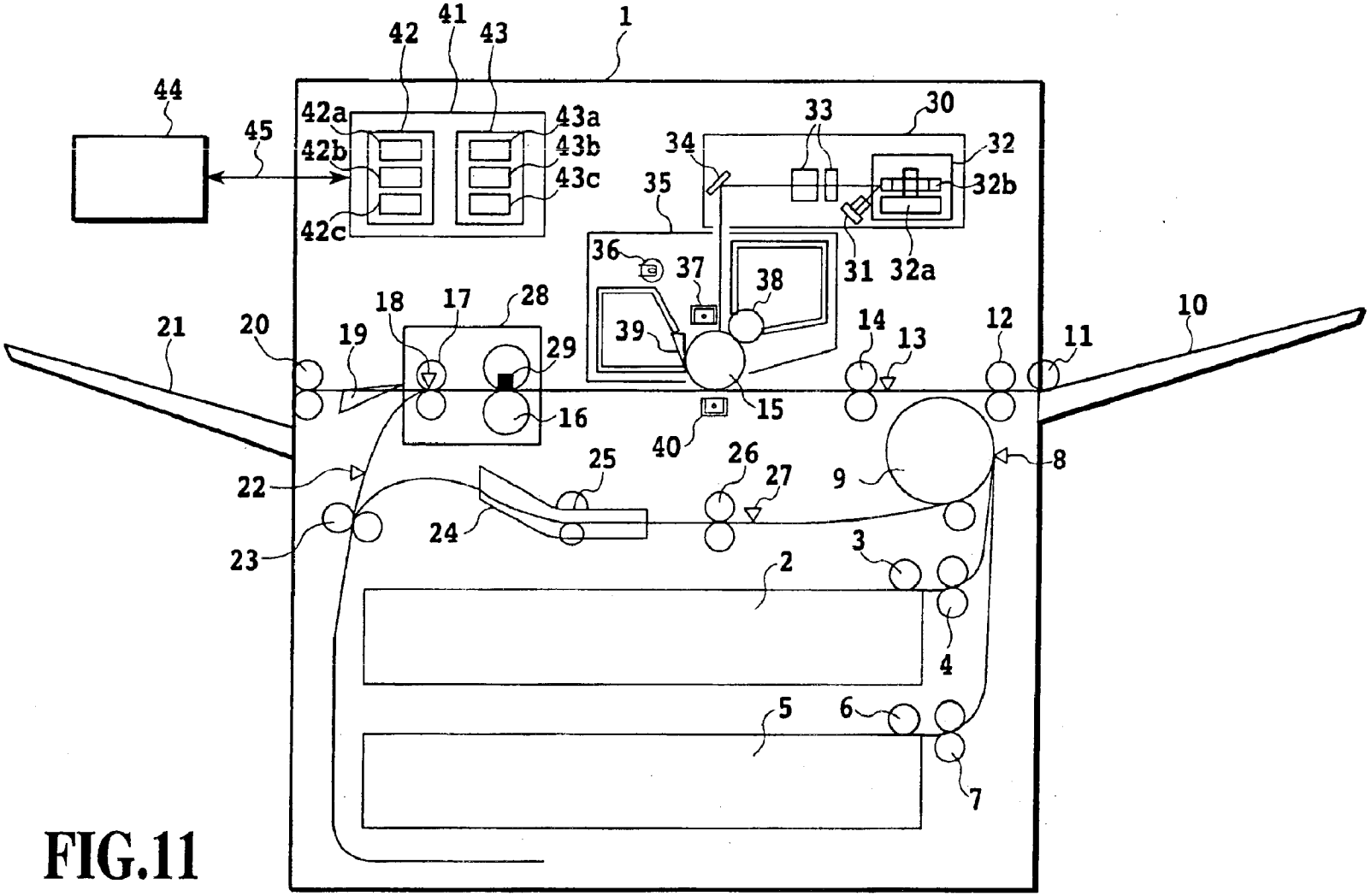
FIG. 11 is a front view showing an arrangement of the second and fifth embodiments of the printing apparatus in accordance with the present invention.

FIG. 11 is a front view showing an arrangement of a second embodiment of the printing apparatus in accordance with the present invention. The second embodiment differs from the first embodiment in the construction of the fixing assembly 28, and hence the description of the same portions as those of the first embodiment will be omitted here. The fixing assembly 28 is a film heating type fixing device, which comprises a heating-pressurizing roller assembly 16 including a heating film and pressurizing roller and a heater 29 consisting of a ceramic heater installed within the heating film.

A temperature detector not shown is put into contact with the surface of the ceramic heater to control the surface temperature of the heating film at constant by turning on and off the heater in response to the detected result of the temperature. As for the film heating type fixing device, since it is the same as that disclosed in Japanese Patent Application Laid-open No. 9-146391 (1997), the detailed description thereof is omitted here. The hot roller type described before must keep the temperature at a certain value (170° C. in the foregoing embodiment 1) even in the standby mode without carrying out the printing. In contrast, the film heating type, which is also called the on-demand type, offers an advantage of being able to keep the heater off in the standby mode because of short warm-up time.

The second embodiment of the printing apparatus in accordance with the present invention has the same functional block diagram as that of FIG. 2. Thus, the description thereof is omitted here.

FIGS. 4A–6E are diagrams showing the print reservation table of the second embodiment of the printing apparatus; and FIGS. 7A–9B are time charts illustrating printing of the second embodiment of the printing apparatus. FIGS. 4A–4G correspond to FIGS. 7A–7D, FIGS. 5A–5H correspond to FIGS. 8A and 8B, and FIGS. 6A–6E correspond to FIGS. 9A and 9B, respectively. Since these figures are the same as those of the first embodiment, their description is omitted here.

Incidentally, in the time chart of the printing, the heater HIGH side refers to the 190° C. temperature regulation, and the heater LOW side refers to the 170° C. temperature regulation in the foregoing embodiment 1. On the other hand, in the present embodiment 2, the heater HIGH side also refers to the 190° C. temperature regulation, but the heater LOW side refers to the off state. In other words, although the present embodiment 2 sets the heater at the 190° C. temperature regulation in the fixing as the hot roller type, it brings the heater into the off state in the standby state in which the fixing is not carried out, which differs from the hot roller type that continues the 170° C. temperature regulation.

Figure 12:
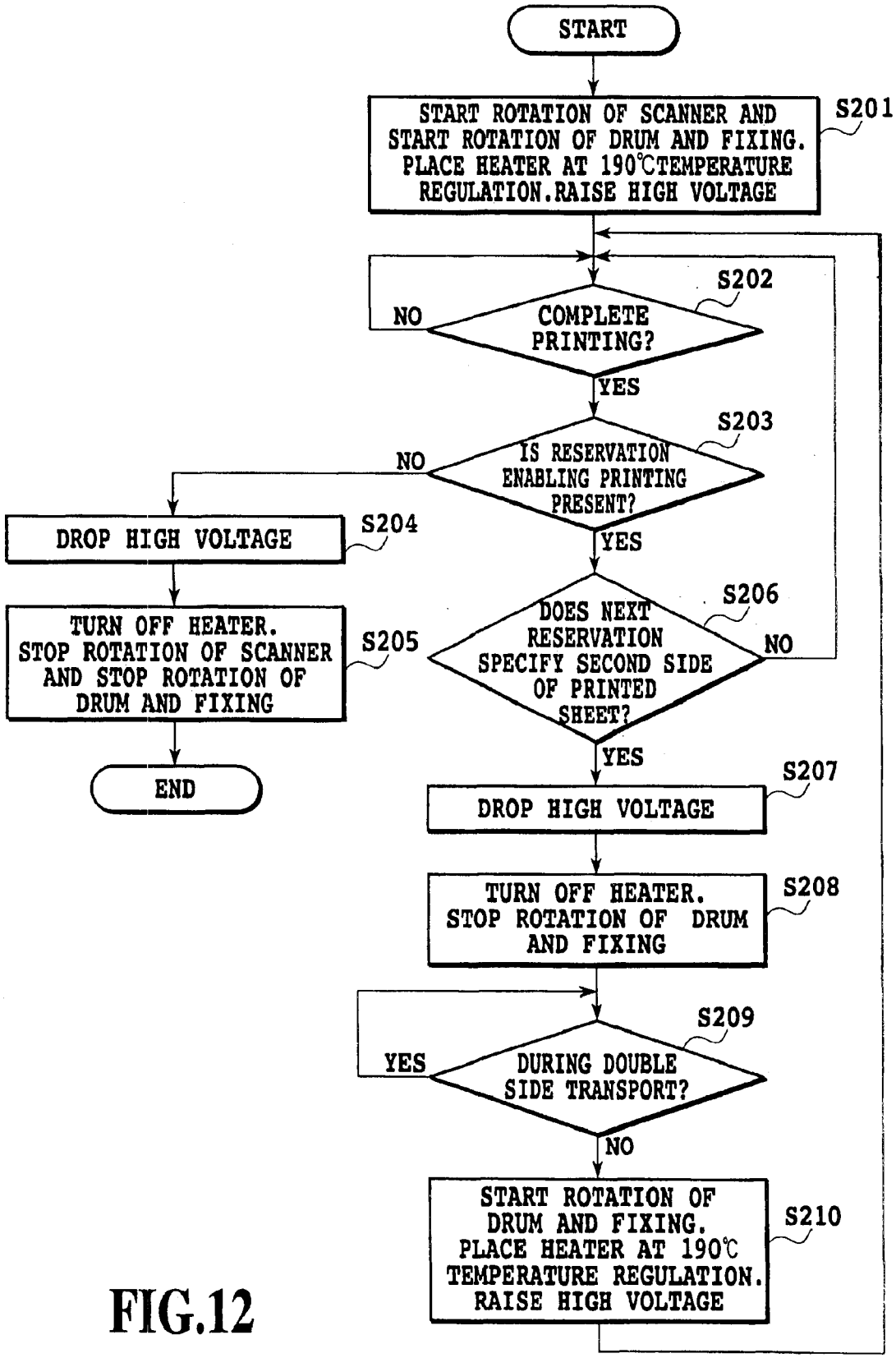
FIG. 12 is a flowchart illustrating the printing control of the controller of the second embodiment in accordance with the present invention.

FIG. 12 is a flowchart illustrating the procedure of the printing operation of the engine controller in the second embodiment of the printing apparatus, which is nearly the same as the flowchart of the first embodiment. In FIG. 12, step S201–step S210 correspond to step S101–S110 of FIG. 10, and only steps S205 and S208 differ from those of FIG. 10. Thus, the description of the remaining steps will be omitted here.

At step S205, after completing the printing, the engine controller 43 turns off the heater, and halts the rotation of the photoconductive drum and that of the fixing pressurizing rollers and the rotation of the scanner motor. The step S205 differs from the step S105 of the foregoing embodiment 1 in that although the embodiment 1 sets the heater at the 170° C. temperature regulation in the standby mode, the present embodiment 2 turns off the heater in the standby mode because it is the film heating type. In addition, at step S208, while the first side is subjected to the double side transport after the printing of the first side has been completed, the engine controller 43 keeps the heater off and halts the rotation of the photoconductive drum and that of the fixing pressurizing rollers. This step S208 differs from the step S108 of the foregoing embodiment 1 in that although the embodiment 1 sets the heater at the 170° C. temperature regulation in the double side transport mode, the present embodiment 2 turns off the heater in the double side transport mode because it is the film heating type.

Thus, the second embodiment is the same as the first embodiment except that the heater is kept of f in the standby mode and double side transport mode. Accordingly, the present embodiment can arrange the optimum print sequence with confirming the subsequent reservation state. As a result, when the printing next to the first side is the second side of the same sheet in the double-sided printing, the present embodiment 2 can take the following actions in the double-sided printing with maintaining the throughput of the double-sided printing. Specifically, utilizing the time period during which the first side of the sheet is reversed and conveyed to the paper refeeding position by the double side transport, the present embodiment 2 can secure the duration of halting the output of the high voltage, the duration of keeping the heater in the off state, and the duration of halting the rotation of the photoconductive drum and that of the fixing pressurizing rollers, or can prolong such a time.

In addition, when the printing following the first side is interrupted or absent, the present embodiment can immediately halt the output of the high voltage, turn off the heater, and stop the rotation of the photoconductive drum and that of the fixing pressurizing rollers without continuing the preparation operation. As a result, the present embodiment 2 can reduce the rotation time of the fixing roller without any means for continuing the preparation operation with maintaining the throughput of the double-sided printing, thereby being able to prolong the life of the fixing assembly. Furthermore, since it can reduce the duration of applying the high voltage and the duration of rotating the photoconductive drum, it can prolong the life of the electrophotographic photoconductive body. Moreover, since it can shorten the duration of keeping the heater in the on state, the duration of applying the high voltage, and the duration of rotating the photoconductive drum and fixing pressurizing rollers, it can reduce the power consumption.

Third Embodiment

Since a view showing an arrangement of the third embodiment of the printing apparatus in accordance with the present invention is the same as FIG. 1, the description thereof is omitted here. In addition, since a functional block diagram showing a configuration of the image recording unit associated with the first embodiment in accordance with the present invention is the same as FIG. 2, the description thereof is omitted here. The third embodiment differs from the first embodiment in that in the paper transport mechanism 46, the photoconductive drum and the fixing pressurizing rollers are driven by independent driving sources to make them rotatable individually of each other without interference. Incidentally, although the photoconductive drum driving motor 52 and heating-pressurizing roller driving motor 54 are shown in FIG. 1 as the independent driving sources, one of the photoconductive drum and fixing pressurizing rollers can be driven by using a single motor and clutches.

Figure 14A:
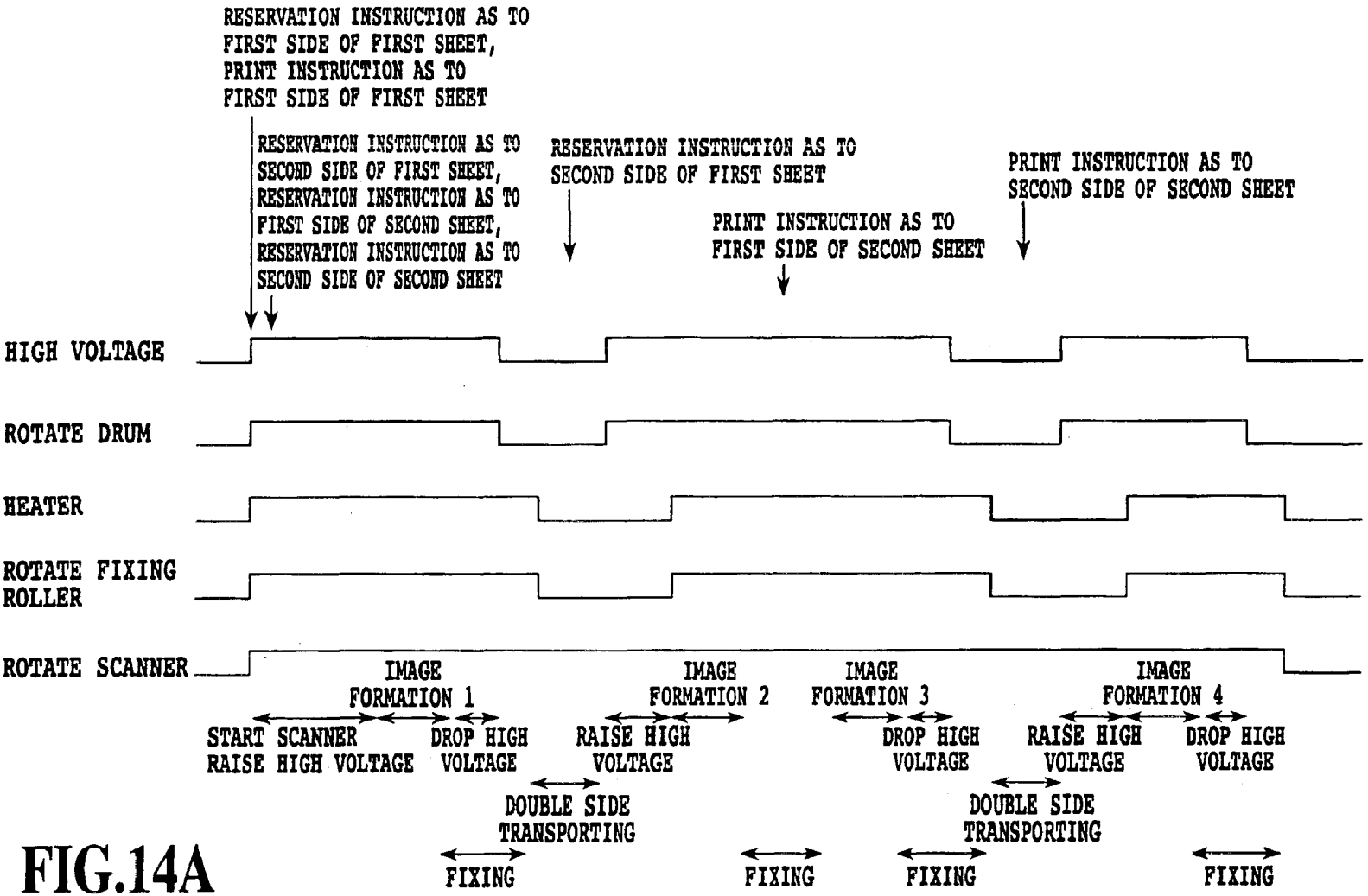
FIGS. 14A and 14B are time charts illustrating printing of the third and fifth embodiments in accordance with the present invention.
Figure 14B:
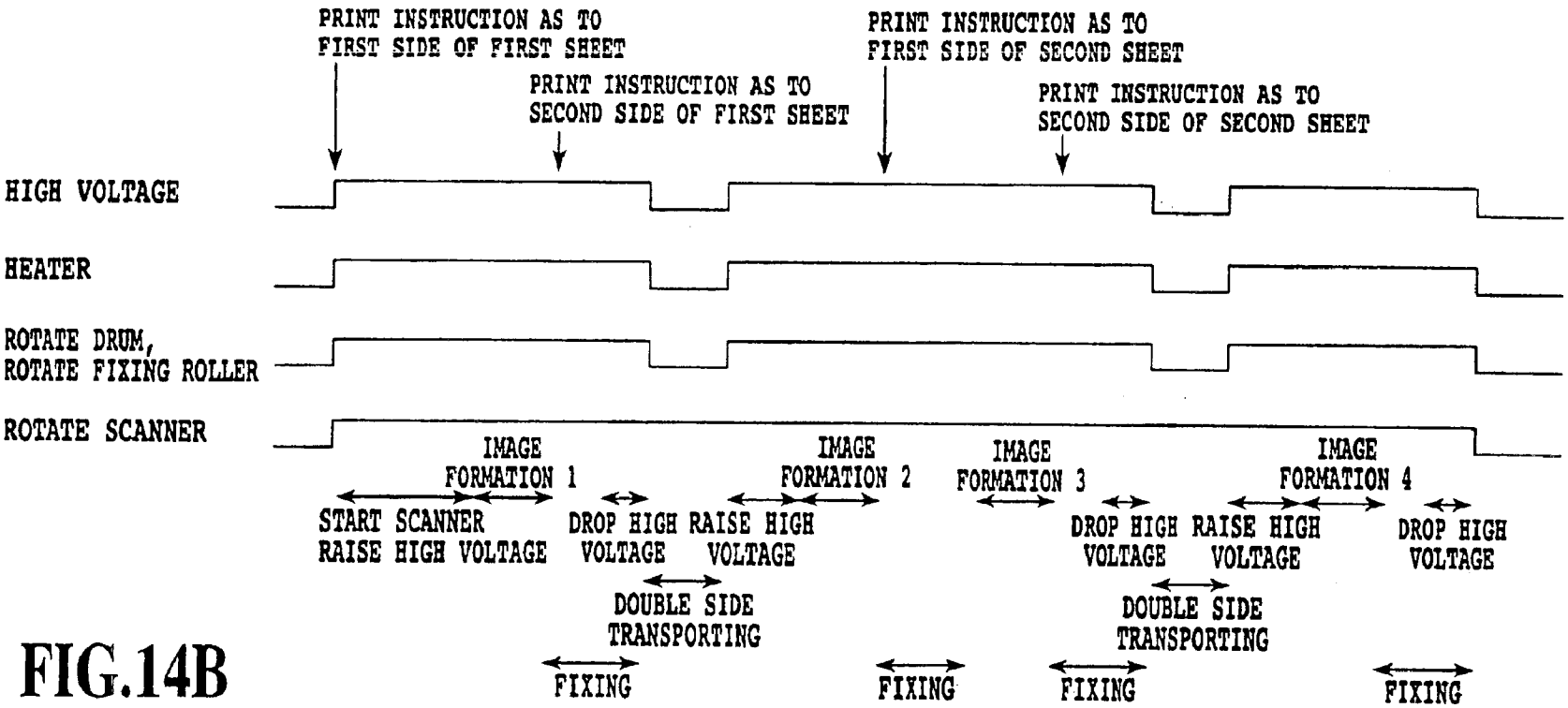
FIG.14B PRIOR ART

FIGS. 13A–13K are diagrams showing a print reservation table of the third embodiment of the printing apparatus; and FIGS. 14A and 14B are time charts illustrating printing of the third embodiment of the printing apparatus. First, FIGS. 13A–13K and FIGS. 14A and 14B assume that double sided printing of two sheets of paper is made on the path from the upper cassette 2 to the paper discharging tray 21. The upper cassette 2 holds at least two sheets of A4-size paper. The double sided printing is carried out in the order of the first side of the first sheet, the second side of the first sheet, the first side of the second sheet, and the second side of the second sheet, thereby printing both sides of each sheet.

The upper cassette 2 holds at least two sheets of A4-size paper. When the image bit development of the first side of the first sheet has been completed, the video controller 42 assigns the ID number of the first side of the first sheet, and issues the print reservation instruction and the print instruction with the printing conditions (ID=4, paper inlet=upper cassette and paper outlet=double side) to the engine controller 43 via the serial communication.

In response to the print reservation instruction sent from the video controller 42, the engine controller 43 stores the printing conditions (ID number, paper inlet and paper outlet) and the paper size at the reservation into the print reservation table in accordance with the order of the reservation. Then, the upper cassette 2 automatically detects the paper size, and registers A4 as the paper size. In addition, "paper feed waiting" is registered as the mode because the paper feed is not yet carried out, and "no error" is registered as the error. As a result, the print reservation information on the first side of the first sheet is registered in the print reservation table as illustrated in FIG. 13A.

Subsequently, the video controller 42 sends the print reservation instructions with the following printing conditions: the second side of the first sheet (ID=4, paper inlet=double side, and paper outlet=paper discharging tray); the first side of the second sheet (ID=7, paper inlet=upper cassette, and paper outlet=double side); and the second side of the second sheet (ID=7, paper inlet=double side, paper outlet=paper discharging tray). Since the paper feed is not carried out, the engine controller 43 registers the "paper feed waiting" and "no error". Then, the engine controller 43 starts the print operation of the first sheet because its printing conditions as to ID=4 have been established.

First, the engine controller 43 starts up the scanner by starting the rotation of the scanner motor. In addition, the engine controller 43 starts to rotate the photoconductive drum and fixing pressurizing rollers, raises the high voltage and drives the heater. As for the heater driving, the engine controller 43 switches it from the standby mode at the 170° C. temperature regulation to the fixing mode at the 190° C. temperature regulation. Then, the engine controller 43 starts the paper feed for ID=4, the initial printing condition. Thus, the engine controller 43 rewrites the mode information on ID=4 of the first side of the first sheet to "paper feeding" as illustrate in FIG. 13B. Since the engine controller 43 has already received the print instruction from the video controller 42 when it completes the paper feed, it starts the image formation by exchanging vertical sync signals (VSREQ signal and VSYNC signal). Thus, the engine controller 43 rewrites the mode information on ID=4 of the first side of the first sheet to "printing" as illustrated in FIG. 13C.

Completing the image formation, the engine controller 43 drops the high voltage, and halts the rotation of the photoconductive drum. In addition, completing the fixing, the engine controller 43 brings the heater driving to the 170° C. temperature regulation as in the standby mode, and stops the rotation of the fixing pressurizing rollers. Then, it waits for the sheet to be reversed and conveyed to the paper refeed position by the double side transport. As illustrated in FIG. 13D, the engine controller 43 rewrites the mode information on ID=4 of the first side of the first sheet to "double side transporting". In the course of this, when the video controller 42 completes the image bit development of the second side of the first sheet, it sends the print instruction as to the second side of the first sheet to the engine controller 43.

When the first side of the first sheet is conveyed to the paper refeed position, the engine controller 43 restarts the rotation of the photoconductive drum, raises the high voltage, and refeeds the paper as the second side of the first sheet. In addition, since the first side of the second sheet has been reserved, the engine controller 43 starts the paper feed of the second sheet from the upper cassette to enable its printing after a predetermined interval following the second side of the first sheet. As illustrated in FIG. 13E, the engine controller 43 rewrites the mode information on ID=4 of the second side of the first sheet to "paper feeding". In addition, since the first side of the first sheet has been shifted to the print operation of the second side, the engine controller 43 rewrites the mode information to "second side management". Furthermore, the engine controller 43 rewrites the mode information on ID=7 of the first side of the second sheet to "paper feeding". Since the engine controller 43 has already received the print instruction from the video controller 42 when it completes the paper refeeding, it exchanges the vertical sync signals (VSREQ signal and VSYNC signal), and starts an image formation. Besides, the engine controller 43 restarts the rotation of the fixing pressurizing rollers, and brings the heater to 190° C. temperature regulation for the fixing. Thus, as illustrated in FIG. 13F, the engine controller 43 rewrites the mode information on ID=4 of the second side of the first sheet to "printing".

The engine controller 43 completes the image formation and the fixing. Then, receiving the print instruction as to the first side of the second sheet from the video controller 42, the engine controller 43 starts the image formation of the first side of the second sheet. Since the second side of the first sheet has been output, the engine controller 43 deletes the information on ID=4 of the first side and second side of the first sheet as illustrated in FIG. 13G, and rewrites the mode information on the first side of the second sheet to "printing".

When the engine controller 43 has completed the image formation, it drops the high voltage, and stops the rotation of the photoconductive drum. In addition, when the fixing has been completed, the engine controller 43 places the heater driving at 170° C. temperature regulation as in the standby mode, halts the rotation of the fixing pressurizing rollers, and waits for the second sheet to be reversed and conveyed to the paper refeed position by the double side transport. As illustrated in FIG. 13H, the engine controller 43 rewrites the mode information on ID=7 of the first side of the second sheet to "double side transporting". In the course of this, when the video controller 42 has completed the image bit development of the second side of the second sheet, it sends the print instruction as to the second side of the second sheet to the engine controller 43.

When the second side of the second sheet is conveyed to the paper refeed position, engine controller 43 restarts the rotation of the photoconductive drum, raises the high voltage, and refeed the sheet as the second side of the second sheet. As illustrated in FIG. 13I, the engine controller 43 rewrites the mode information on ID=7 of the second side of the second sheet to "paper feeding". In addition, since the first side of the second sheet has been shifted to the print operation of the second side, the engine controller 43 rewrites the mode information to "second side management". Since the engine controller 43 has already received the print instruction from the video controller 42 when it completes the paper refeeding, it starts the image formation by exchanging the vertical sync signals (VSREQ signal and VSYNC signal). At the same time, the engine controller 43 restarts the rotation of the fixing pressurizing rollers, and places the heater at 190° C. temperature regulation for the fixing. Thus, the engine controller 43 rewrites the mode information on ID=7 of the second side of the second sheet to "printing" as illustrated in FIG. 13J.

The engine controller 43 completes the image formation, starts the fixing, drops the high voltage, and stops the rotation of the photoconductive drum. Then, the engine controller 43 switches the heater driving to 170° C. after completing output of the fixed paper, stops the rotation of the fixing pressurizing rollers, and the rotation of the scanner motor. Since the second side of the second sheet has been output, the engine controller 43 deletes the information on ID=7 of the first side and second side of the second sheet, thereby placing them in the out of reservation condition as illustrated in FIG. 13K.

Let us ensure the foregoing operation in the time chart of the printing as illustrated in FIG. 14A. First, the engine controller 43 starts the rotation of the scanner and the rotation of the photoconductive drum and that of the fixing pressurizing rollers, raises the high voltage, and switches the heater to the 190° C. temperature regulation. After completing various start-ups and paper feed, the engine controller 43 carries out the image formation of the first side of the first sheet and the fixing with reducing the high voltage, and stops the rotation of the photoconductive drum. After the fixing, starting the double side transport which reverses the paper and conveys it to the paper refeeding position, the engine controller 43 switches the heater driving from the 190° C. temperature regulation to 170° C. temperature regulation, and stops the rotation of the fixing pressurizing rollers. Subsequently, when the first side of the first sheet is transported to the paper refeeding position, the engine controller 43 restarts the rotation of the photoconductive drum, raises the high voltage, and starts the paper refeeding as the second side of the first sheet.

On the other hand, the engine controller 43 also starts the paper feed of the first side of the second sheet. After raising the high voltage and completing paper refeeding, the engine controller 43 switches the heater from the 170° C. temperature regulation to the 190° C. temperature regulation, restarts the rotation of the fixing pressurizing rollers, and starts the image formation of the second side of the first sheet. Carrying out the fixing of the second side of the first sheet, the engine controller 43 starts the image formation of first side of the second sheet. After completing the image formation of the first side of the second sheet, the engine controller 43 carries out the fixing with reducing the high voltage, and halts the rotation of the photoconductive drum. After the fixing, starting the double side transport which reverses the paper and conveys it to the paper refeeding position, the engine controller 43 switches the heater driving from the 190° C. temperature regulation to 170° C. temperature regulation, and stops the rotation of the fixing pressurizing rollers.

Subsequently, when the first side of the second sheet is conveyed to the paper refeeding position, the engine controller 43 restarts the rotation of the photoconductive drum, raises the high voltage, and starts the paper refeeding as the second side of the second sheet. After raising the high voltage and completing the paper refeeding, the engine controller 43 switches the heater from the 170° C. temperature regulation to the 190° C. temperature regulation, restarts the rotation of the fixing pressurizing rollers, and starts the image formation of the second side of the second sheet. The engine controller 43 carries out the image formation of the second side of the second sheet, and drops the high voltage with outputting the fixed paper, and stops the rotation of the photoconductive drum. When the fixed paper is output, the engine controller 43 switches the heater driving from the 190° C. temperature regulation to the 170° C. temperature regulation, and halts the rotation of the fixing pressurizing rollers and the rotation of the scanner motor.

In contrast, FIG. 14B is a time chart illustrating printing by the conventional example. As disclosed in Japanese Patent Application Laid-open No. 8-320642 (1996), the method prints the first side, reverses the sheet and refeeds it, and prints the second side. When there is a printing instruction as to the second side after completing the printing of the first side in this method, it prevents scraping of the photoconductive drum and waste of the heater power by halting the output of the high voltage and reducing the temperature of the heater. However, the conventional example cannot drive the photoconductive drum and fixing pressurizing rollers individually. Accordingly, the step of the image formation (high voltage) and the step of fixing (heater) interfere with each other, so that the rotation of the photoconductive drum and that of the fixing pressurizing rollers can be stopped only when both the steps are unnecessary.

According to the present invention, a contrivance is made to drive the photoconductive drum and fixing pressurizing rollers individually. Thus, completing the image formation, the engine controller 43 drops the high voltage and halts the rotation of the photoconductive drum, first. Subsequently, completing the fixing, the engine controller 43 reduces the temperature of the heater and stops the rotation of the fixing pressurizing rollers. In addition, along with the paper refeeding, the engine controller 43 restarts the rotation of the photoconductive drum and raises the high voltage, and subsequently, it increases the temperature of the heater and restarts the rotation of the fixing pressurizing rollers. As a result, the printer in accordance with the present invention as illustrated in FIG. 14A has the advantage over the conventional example as illustrated in FIG. 14B in that it can prolong the duration of halting the high voltage and that of halting the rotation of the photoconductive drum during the double side transport, and prolong the duration of reducing the heater temperature and that of halting the rotation of the fixing pressurizing rollers.

Figure 15:
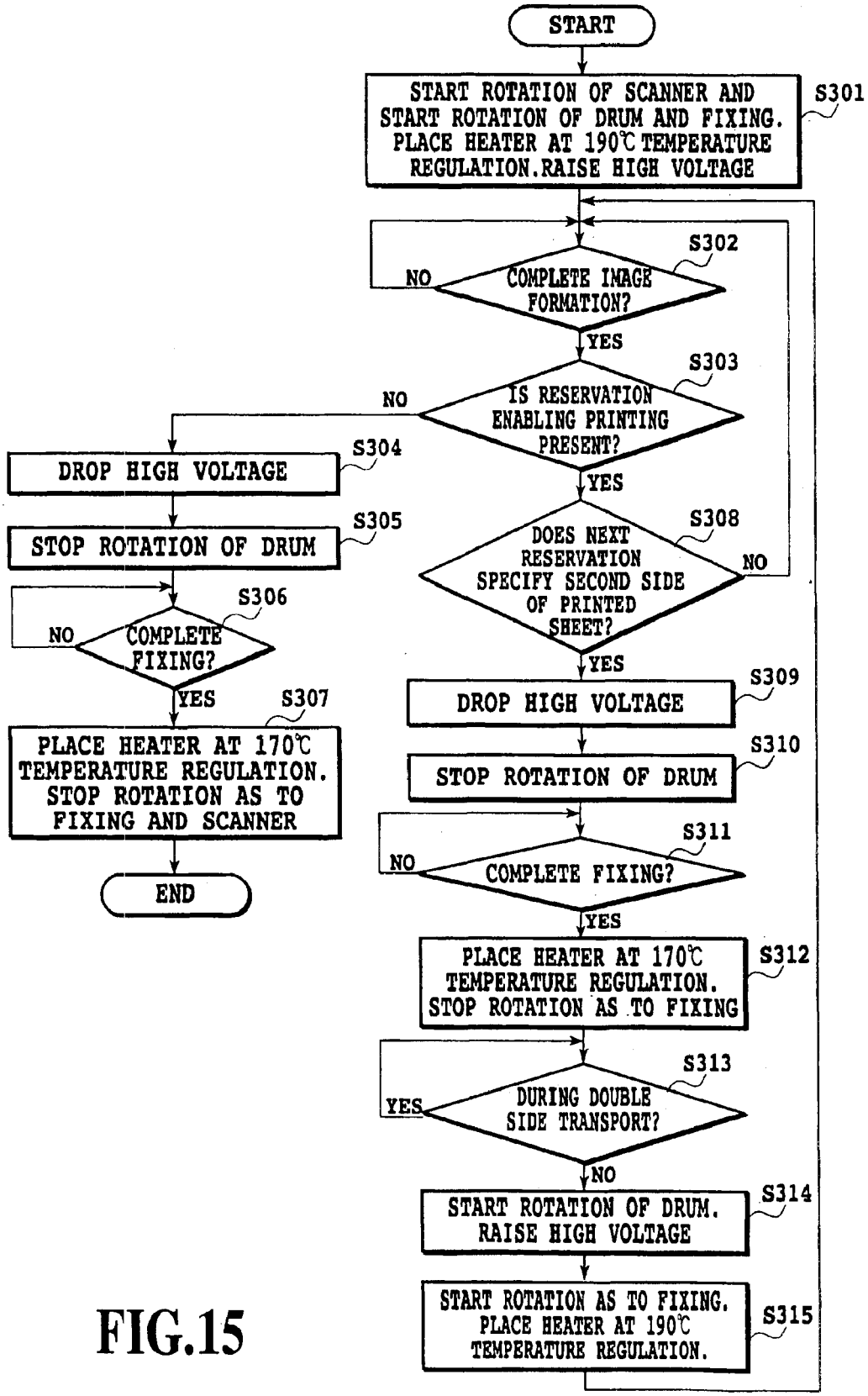
FIG. 15 is a flowchart illustrating the printing control of the controller of the third embodiment in accordance with the present invention.

FIG. 15 is a flowchart illustrating the procedure of the printing operation by the engine controller of the third embodiment of the printing apparatus. The engine controller 43 starts the printing operation in response to the print reservation instruction and print instruction enabling the print operation.

First, the engine controller 43 drives the scanner motor, photoconductive drum and fixing pressurizing rollers, switches the heater driving to 190° C. temperature regulation, and raises the high voltage at step S301. Then, it waits for the completion of the initial image formation at step S302. When the image formation has been completed, the engine controller 43 checks whether the print reservation enabling the next printing is present or not at step S303. If no print reservation enabling the next printing is present, the engine controller 43 drops the high voltage at step S304, and halts the rotation of the drum at step S305. Then, waiting for the completion of the fixing at step S306, the engine controller 43 switches the heater to the 170° C. temperature regulation, stops the rotation of the fixing pressurizing rollers and the rotation of the scanner motor at step S307, and terminates the printing operation.

On the other hand, when the print reservation enabling the next printing is present after completing the image formation, the engine controller 43 checks whether the next reservation is associated with the second side of the printed sheet at step S308. If the reservation is not associated with the second side of the printed sheet, the engine controller 43 carries out the printing of the next reservation and returns the processing to step S302. If the reservation is associated with the second side of the printed sheet, the engine controller 43 drops the high voltage at step S309 and halts the rotation of the drum at step S310. Then, it awaits the completion of the fixing at step S311, places the heater at 170° C. temperature regulation, and stops the rotation of the fixing pressurizing rollers at step S312.

Subsequently, the engine controller 43 waits for the sheet of the first side to be reversed and conveyed to the paper refeed position by the double side transport at step S313. When the double side transport has been completed, the engine controller 43 restarts the rotation of the photoconductive drum and raises the high voltage at step S314. In addition, it places the heater at 190° C. temperature regulation, and restarts the rotation of the fixing pressurizing rollers at step S315. Then, the engine controller 43 carries out the printing of the second side and returns the processing to step S302.

As described above, the present embodiment 3 is configured such that it can drive the photoconductive drum and the fixing pressurizing rollers individually. As a result, when printing the second side following the printing of the first side, the present embodiment 3 can take the following steps: when the image formation has been completed, it drops the high voltage and stops the rotation of the photoconductive drum, first; and when the fixing has been completed, it reduces the temperature of the heater and stops the rotation of the fixing pressurizing rollers. In addition, along with the paper refeeding of the second side, it can restart the rotation of the photoconductive drum and raise the high voltage, first; and subsequently, it can increase the temperature of the heater and restarts the rotation of the fixing pressurizing rollers.

As a result, the present embodiment has an advantage over the conventional example in that it can prolong the duration of halting the high voltage and that of halting the rotation of the photoconductive drum during the double side transport, and prolong the duration of reducing the heater temperature and that of halting the rotation of the fixing pressurizing rollers. Consequently, it can shorten the period of time of the rotation of the fixing pressurizing rollers and hence prolong the life of the fixing assembly. In addition, it can shorten the period of time of applying the high voltage and that of the rotation of the photoconductive drum, thereby being able to prolong the life of the electrophotographic photoconductive body. Furthermore, it can shorten the duration of the high temperature of the heater, the duration of applying the high voltage, the duration of rotating the photoconductive drum, and the duration of rotating the fixing pressurizing rollers. Thus, the present embodiment 3 can reduce the power consumption.

Forth Embodiment

Since a view showing an arrangement of the fourth embodiment of the printing apparatus in accordance with the present invention is the same as FIG. 1, the description thereof is omitted here. In addition, since a functional block diagram showing a configuration of the image recording unit associated with the fourth embodiment in accordance with the present invention is the same as FIG. 2, the description thereof is omitted here. As the third embodiment, the fourth embodiment differs from the first embodiment in that the photoconductive drum and the fixing pressurizing rollers in the paper transport mechanism 46 are driven by independent driving sources so that they are rotatable individually of each other without interference.

In addition, since the diagrams showing a print reservation table of the fourth embodiment of the printing apparatus are the same as those of the third embodiment as shown in FIGS. 13A–13K, their description is omitted here.

Figure 16:
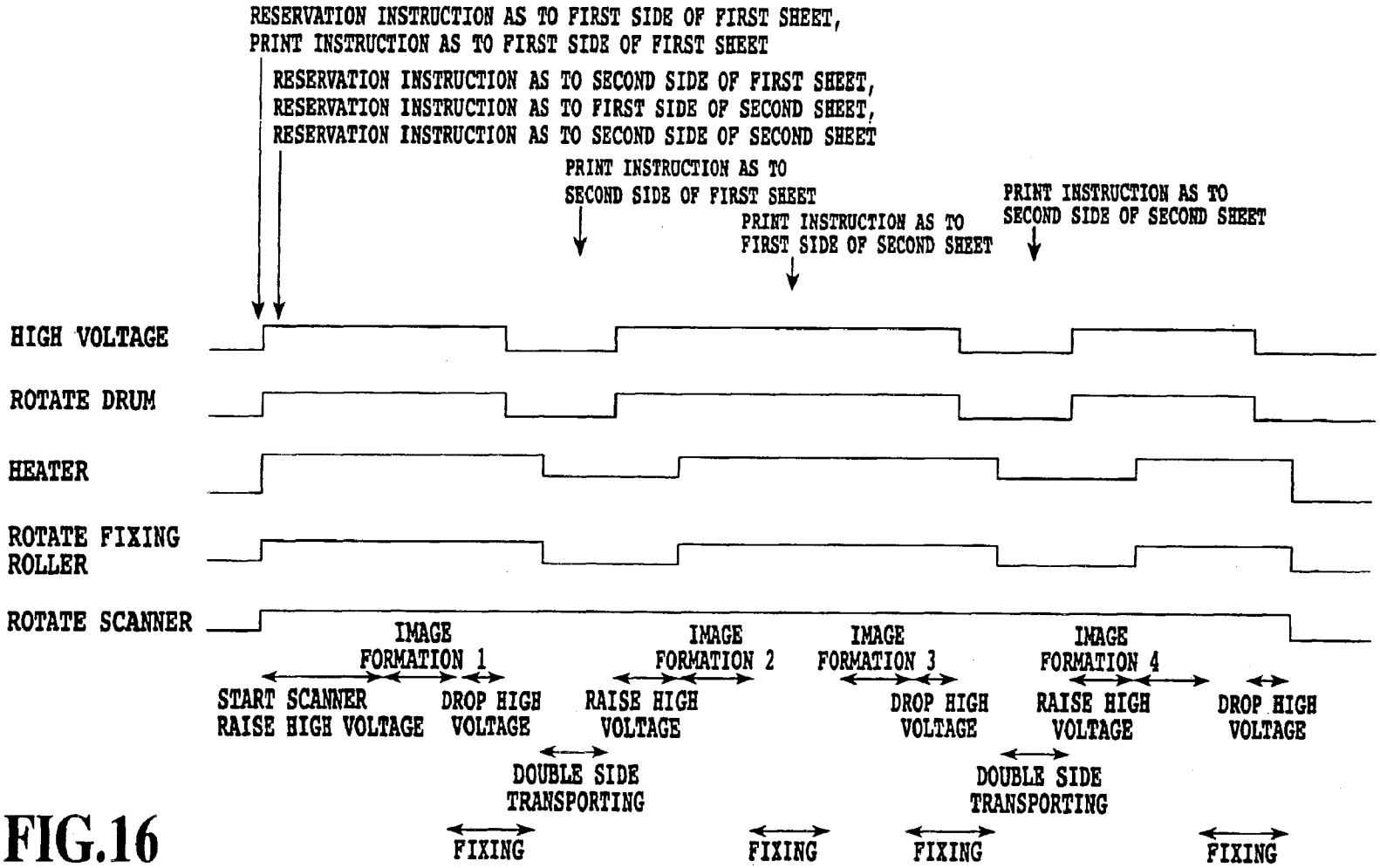
FIG. 16 is a time chart illustrating printing of the fourth embodiment in accordance with the present invention.

FIG. 16 is a time chart illustrating printing of the fourth embodiment of the printing apparatus. It differs from the time chart of the third embodiment as illustrated in FIG. 14A in the heater driving. Although the heater HIGH side refers to the 190° C. temperature regulation and the heater LOW side refers to the 170° C. temperature regulation in the embodiment 3, the present embodiment 4 has an additional 180° C. temperature regulation between the heater HIGH side and the heater LOW side as a MIDDLE temperature regulation. In other words, although it is the same as the third embodiment in applying the 190° C. temperature regulation to the fixing and the 170° C. temperature regulation to the standby mode, the fourth embodiment differs in applying the 180° C. temperature regulation to the "double side transporting" condition in the sequence of the double-sided printing.

The hot roller fixing method carries out the fixing by an amount of heat accumulated in the fixing roller and pressurizing roller constituting the fixing pressurizing roller pair. In view of this, when the printing of the second side is scheduled in advance, the fixing characteristic of the second side is improved by maintaining them at 180° C. which is higher than 170° C. in the standby mode, but is lower than the 190° C. for the fixing.

Figure 17:
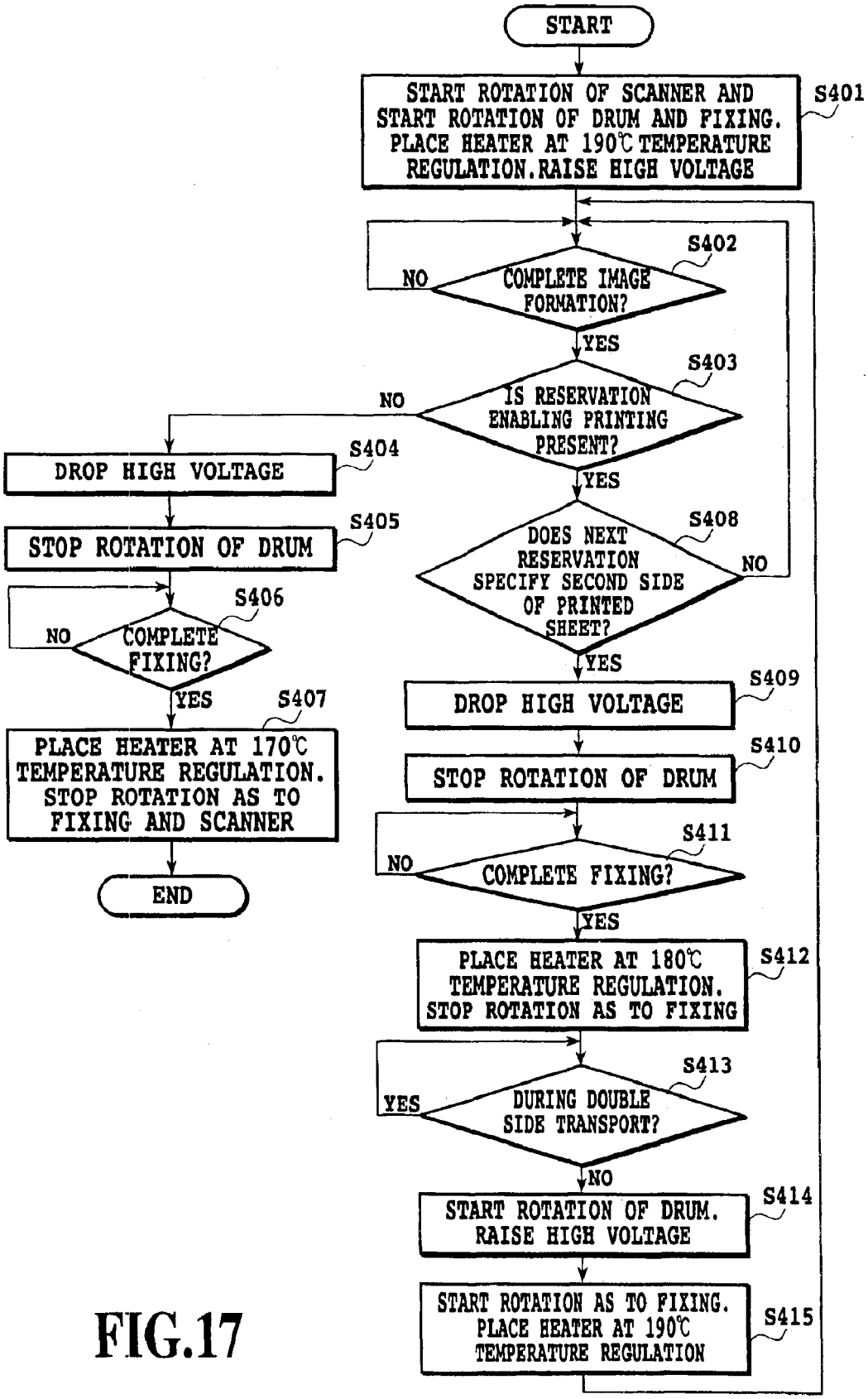
FIG. 17 is a flowchart illustrating the printing control of the controller of the fourth embodiment in accordance with the present invention.

FIG. 17 is a flowchart illustrating the procedure of the printing operation of the engine controller in the fourth embodiment of the printing apparatus, which is nearly the same as the flowchart of FIG. 15 of the third embodiment. In FIG. 17, steps S401–S415 correspond to steps S301–S315 of FIG. 15, and only step S412 differs from that of FIG. 15. Thus, the description of the remaining steps will be omitted here.

At step S412 after completing the fixing, the engine controller 43 places the heater at 180° C. temperature regulation and stops the rotation of the fixing pressurizing rollers. It differs from the step S312 of the embodiment 3 in that although the embodiment 3 places the heater to the 170° C. temperature regulation during the double side transport mode, the present embodiment 4 places the heater at the 180° C. temperature regulation.

The difference from the embodiment 3 is only the temperature regulation during the double side transport mode: whether to set at 170° C. or 180° C. Therefore as the embodiment 3, the present embodiment 4 can prolong the duration of halting the high voltage and that of halting the rotation of the photoconductive drum during the double side transport, and prolong the duration of reducing the heater temperature and that of halting the rotation of the fixing pressurizing rollers as compared with the conventional example. Consequently, it can shorten the period of time of the rotation of the fixing pressurizing rollers and hence prolong the life of the fixing assembly. In addition, it can shorten the period of time of applying the high voltage and that of the rotation of the photoconductive drum, thereby being able to prolong the life of the electrophotographic photoconductive body. Furthermore, it can shorten the duration of the high temperature of the heater, the duration of applying the high voltage, the duration of rotating the photoconductive drum, and the duration of rotating the fixing pressurizing rollers. Thus, the present embodiment 4 can reduce the power consumption.

Fifth Embodiment

Since a view showing an arrangement of the fifth embodiment of the printing apparatus in accordance with the present invention is the same as the second embodiment as shown in FIG. 11, the description thereof is omitted here. In addition, since a functional block diagram showing a configuration of the image recording unit associated with the fifth embodiment in accordance with the present invention is the same as the first embodiment as shown in FIG. 2, the description thereof is omitted here. As the third embodiment, the fifth embodiment differs from the first embodiment in that the photoconductive drum and the fixing pressurizing rollers in the paper transport mechanism 46 are driven by independent driving sources so that they are rotatable individually of each other without interference.

In addition, since the diagrams showing a print reservation table of the fifth embodiment of the printing apparatus are the same as those of the third embodiment shown in FIGS. 13A–13K, their description is omitted here. Furthermore, since the time charts illustrating printing of the fourth fifth embodiment of the printing apparatus are the same as those of the third embodiment as shown in FIGS. 14A and 14B, their description is omitted here. Incidentally, although in the time charts of printing, the heater HIGH side refers to the 190° C. temperature regulation and the heater LOW side refers to the 170° C. temperature regulation in the embodiment 3, the heater HIGH side refers to the 190° C. temperature regulation and the heater LOW side refers to the heater off in the present embodiment 5. In other words, although the present embodiment 5 employs the 190° C. temperature regulation during the fixing as the hot roller method of the embodiment 3, the present embodiment 5 differs from the hot roller method in the following. The film heating method of the present embodiment 5 differs from the hot roller method, which continues the 170° C. temperature regulation during the standby mode in which the fixing is not carried out, in that it turns off the heater.

Figure 18:
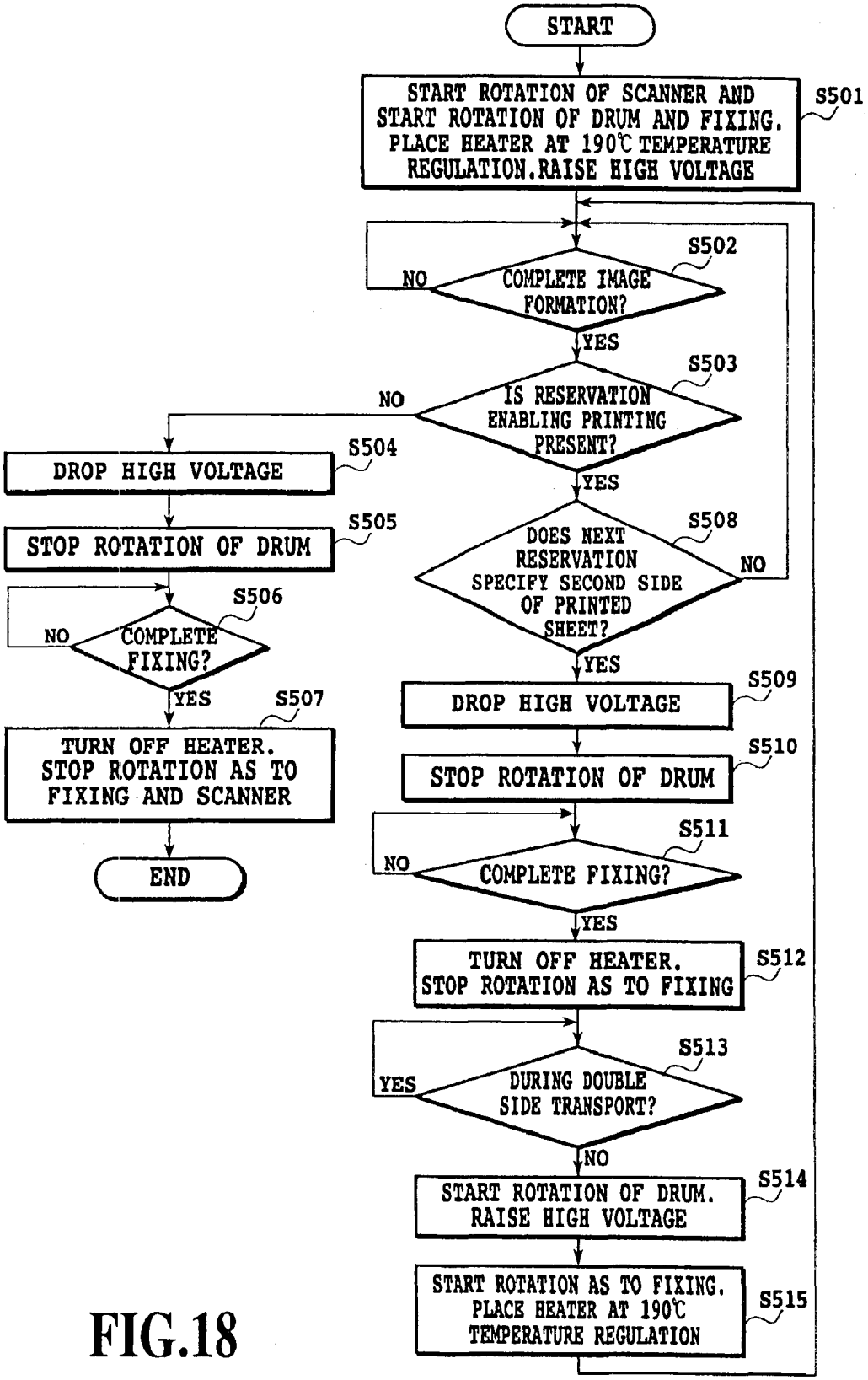
FIG. 18 is a flowchart illustrating the printing control of the controller of the fifth embodiment in accordance with the present invention.

FIG. 18 is a flowchart illustrating the procedure of the printing operation of the engine controller in the fifth embodiment of the printing apparatus, which is nearly the same as the flowchart of FIG. 15 of the third embodiment. In FIG. 18, steps S501–S515 correspond to steps S301–S315 of FIG. 15, and only steps S507 and S512 differ from those of FIG. 15. Thus, the description of the remaining steps will be omitted here.

At step S507 after completing the fixing, the engine controller 43 turns off the heater and stops the rotation of the fixing pressurizing rollers. It differs from the step S307 of the embodiment 3 in that although the hot roller method of the embodiment 3 places the temperature regulation at 170° C. in the standby mode, the film heating method of the present embodiment 5 turns off the heater in the standby mode. At step S512 after completing the fixing, the engine controller 43 turns off the heater and halts the rotation of the fixing pressurizing rollers. It differs from the step S312 of the embodiment 3 in that although the embodiment 3 places the heater at the 170° C. temperature regulation in the double side transport mode, the present embodiment 5 turns off the heater.

The difference from the embodiment 3 is only the temperature regulation during the standby mode and the double side transport mode: whether to set at 170° C. or to turn off. Therefore as the embodiment 3, the present embodiment 5 can prolong the duration of halting the output of the high voltage and that of halting the rotation of the photoconductive drum during the double side transport, and prolong the duration of reducing the heater temperature and that of halting the rotation of the fixing pressurizing rollers as compared with the conventional example. Consequently, it can shorten the period of time of the rotation of the fixing pressurizing rollers and hence prolong the life of the fixing assembly. In addition, it can shorten the period of time of applying the high voltage and that of the rotation of the photoconductive drum, thereby being able to prolong the life of the electrophotographic photoconductive body. Furthermore, it can shorten the duration of keeping the heater in the on state, the duration of applying the high voltage, the duration of rotating the photoconductive drum, and the duration of rotating the fixing pressurizing rollers. Thus, the present embodiment 5 can reduce the power consumption.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus comprising:

an image forming section for forming an image on a recording medium using an electrophotographic method;

a fixing unit for fixing the image on the recording medium thereto by heating and pressurizing the recording medium with a pair of fixing rotation members;

a reversing mechanism for reversing the recording medium having a fixed image on its first side, to print an image on a second side of the recording medium; and a controller for controlling the rotation of said fixing rotation members and said image forming section, wherein, when printing the second side of the recording medium subsequent to printing the first side of the recording medium, said controller temporarily stops rotation of said fixing rotation members after the recording medium passes through said fixing unit for fixing the image on the first side of the recording medium and before fixing the image on the second side of the recording medium.

2. The printing apparatus as claimed in claim 1, wherein, when printing a second recording medium subsequent to printing a first recording medium, said controller does not stop rotation of said fixing rotation members for at least a predetermined time after said first recording medium has passed through said fixing unit for fixing the image on the first recording medium.

3. The printing apparatus as claimed in claim 1, wherein, when printing the second side of the recording medium subsequent to printing the first side of the recording medium, said controller stops the rotation of said fixing rotation members after said recording medium has passed through said fixing unit, carries out paper refeeding after reversing the recording medium, starts the image formation of the second side, and restarts the rotation of said fixing rotation members previously by a period of time required for said fixing rotation members to reach a specified rotation speed by the time when the second side arrives at said fixing unit.

4. The printing apparatus as claimed in claim 1, wherein, when printing the second side of the recording medium subsequent to printing the first side of the recording medium, a high voltage applied to an electrophotographic process is temporarily reduced after completing the image formation onto the first side of the recording medium.

5. The printing apparatus as claimed in claim 1, wherein, a rotation of said fixing rotation members is controllable independent of rotation members in said image forming section and, when printing the second side of the recording medium subsequent to printing the first side of the recording medium, a high voltage applied to an electrophotographic process is reduced and rotation of the rotation members in said image forming section is stopped after completing the image formation onto the first side of the recording medium, and carries out paper refeeding after reversing said recording medium, restarting of the rotation of the rotation members in said image forming section, and raising of the high voltage of said electrophotographic process, the restarting of the rotation of the rotation members in said image forming section and the raising of the high voltage being performed previously by a period of time equal to a sum of a rising time of the rotation of the rotation members in said image forming section and a rising time of the high voltage of said electrophotographic process in order to complete the rising of the high voltage of the electrophotographic process by the time when starting an image formation of the second side.

6. The printing apparatus as claimed in claim 1, further comprising a rotary polygon mirror for exposing said image forming section to light, wherein rotational driving of said rotary polygon mirror is continued even when rotation of said fixing rotation members or rotation of the rotation members in said image forming section is halted subsequent to printing the first side of the recording medium and before printing the second side of the recording medium.

7. The printing apparatus as claimed in claim 1, further comprising a heater driving controller, wherein said heater driving controller halts a driving of a heater in said fixing units as long as the rotation of said fixing rotation members is halted, when printing the second side of the recording medium subsequent to printing the first side of the recording medium.

8. The printing apparatus as claimed in claim 1, further comprising a heater driving controller, wherein said heater driving controller controls a driving of heater in said fixing unit so that said fixing unit is at a first temperature in a standby mode during which printing is not performed, at a second temperature in a printing condition during which printing is performed, at a third temperature as long as the rotation of said fixing rotation members is halted, when printing the second side of the recording medium subsequent to printing the first side of the recording medium.

9. The printing apparatus as claimed in claim 8, wherein the third temperature is higher than the first temperature, and lower than or equal to the second temperature.

10. The printing apparatus as claimed in claim 1, wherein said fixing unit consists of a hot roller type fixing unit.

11. The printing apparatus as claimed in claim 1, wherein said fixing unit consists of a film heating type fixing unit.

12. A printing apparatus comprising:

an image forming section for forming an image on a recording medium using an electrophotographic method;

a fixing unit for fixing an image on the recording medium thereto by heating and pressurizing the recording medium, with a pair of fixing rotation members;

a reversing mechanism for reversing the recording medium having a fixed image on its first side, to print an image on a second side of the recording medium;

a print reservation receiver for receiving a reservation instruction as to the printing operation specifying a printing condition;

a print controller for controlling a printing operation according to the received reservation instruction; and a decision unit for making a decision as to whether printing of the second side of the recording medium is carried out subsequent to printing the first side of the recording medium.

13. The printing apparatus as claimed in claim 12, wherein said decision unit makes a decision, when an image formation of the first side is completed, as to whether printing of the second side of the recording medium is carried out subsequent to printing the first side of the recording medium in accordance with printing condition of a next reserved printing operation.

14. The printing apparatus as claimed in claim 12, wherein said decision unit makes a decision, when fixing of the first side is completed, as to whether printing of the second side of the recording medium is carried out subsequent to printing the first side of the recording medium in accordance with printing condition of a next reserved printing operation.

15. The printing apparatus as claimed in claim 12, wherein said print controller further carries out:

shifting its processing to a standby mode after completing printing of the first side, when no printing operation reserved next to the printing of the first side of the recording medium is present, by dropping the high voltage of the electrophotographic process, by stopping rotational driving of said image forming section, by halting rotational driving of said fixing rotation members, by reducing the temperature of said fixing unit, and by stopping rotational driving of said scanner motor for carrying out scanning of said electrophotographic process;

shifting its processing to printing operation of the second side, when a printing operation reserved next to the printing of the first side of the recording medium is associated with the second side of the recording medium, by dropping the high voltage of the electrophotographic process, by stopping rotation of rotation members in said image forming section, by halting rotation of said fixing rotation members, and by reducing the temperature of the fixing unit, and simultaneously with the refeeding of the second side, by restarting the rotation of the rotation members in said image forming section, by raising the high voltage of the electrophotographic process, by restarting the rotation of said fixing rotation members, and by increasing the temperature of the fixing unit; and shifting its processing to the next reserved printing operation, when the next reserved printing operation at a time the printing operation of the first side of the recording medium is completed differs from a printing operation of the second side of the recording medium, by dropping the high voltage of said electrophotographic process without stopping the rotation of the rotation members in said image forming section.

16. The printing apparatus as claimed in claim 15, wherein when a printing operation is impossible even though the printing operation reserved next to the printing of the first side of the recording medium is present, said print controller shifts its processing to standby mode by dropping the high voltage of the electrophotographic process, by stopping rotation of rotation members in said image forming section, by halting rotation of rotation members in said fixing rotation members, by reducing the temperature of the fixing unit, and by stopping rotation of said scanner motor for carrying out scanning of said electrophotographic process.

17. The printing apparatus as claimed in claim 12, further comprising heater driving controller, wherein said heater driving controller for halting a driving of a heater in said fixing unit as long as the rotation of said fixing rotation members is halted, when printing the second side of the recording medium subsequent to printing the first side of the recording medium.

18. The printing apparatus as claimed in claim 12, wherein said fixing unit consists of a hot roller type fixing unit.

19. The printing apparatus as claimed in claim 12, wherein said fixing unit consists of a film heating type fixing unit.

20. A printing apparatus comprising:

an image forming section for forming an image on a recording medium;

a fixing unit for fixing the image on the recording medium thereto by heating and pressurizing the recording medium with a pair of fixing rotation members;

a data receiving unit for receiving data relating to a page to be printed; and a controller for controlling a rotation of said fixing rotation members, wherein in a case that said data receiving unit has received data relating to a next page, said controller has a first mode in which the fixing rotation members are rotated at least for a predetermined time after fixing an image of a current page, and a second mode in which the rotation of said fixing rotation members is halted after fixing the image of the current page without waiting a predetermined time regardless of receiving data relating to the next page.

21. A printing apparatus according to claim 20, wherein the rotation of said fixing rotation members is restarted to fix an image of the next page in the second mode after the rotation of said fixing rotation members.

22. A printing apparatus according to claim 20, wherein the second mode is selected when the current page corresponds to a first side of the recording medium and the next page corresponds to a second side of the recording medium.

23. A printing apparatus according to claim 20, wherein a heater of said fixing unit is turned off or said fixing unit is controlled such that temperature thereof becomes lower in the second mode while the rotation of said fixing rotation members is halted.

24. A printing apparatus according to claim 20, wherein said image forming section comprises a rotary polygon mirror and rotational driving of said rotary polygon mirror is continued even when rotation of said fixing rotation members is stopped in said second mode.

25. A printing apparatus according to claim 20, wherein data relating to a page to be printed is a reservation instruction as to a page of printing operation specifying a printing condition.

26. A printing apparatus according to claim 20, wherein one of the first mode and second mode is further selected based on the reservation instruction.

27. A printing apparatus according to claim 20, wherein the rotation of said fixing rotation members is controllable independent of rotation members in said image forming section.

* * * * *

UNITED STATES PATENT AND TRADEMARK OFFICE

CERTIFICATE OF CORRECTION

PATENT NO. : 6,885,834 B2
DATED : April 26, 2005
INVENTOR(S) : Mitsuhiro Ito et al.

It is certified that error appears in the above-identified patent and that said Letters Patent is hereby corrected as shown below:

Column 2,
Line 39, “reaches” should read -- reach --; and “the worn” should read -- wearing --.

Column 3,
Line 61, “when” should read -- of --.

Column 8,
Line 2, “restarts” should read -- restart --.
Line 54, “42*d*” should read -- 42*d* to --.

Column 10,
Line 17, “illustrate” should read -- illustrated --.

Column 14,
Line 30, “refeed” should read -- refed --.

Column 20,
Line 2, “of f” should read -- off --.

Column 21,
Line 43, “illustrate” should read -- illustrated --.

Column 22,
Line 53, “refeed” should read -- refeeds --.

UNITED STATES PATENT AND TRADEMARK OFFICE

CERTIFICATE OF CORRECTION

PATENT NO. : 6,885,834 B2
DATED : April 26, 2005
INVENTOR(S) : Mitsuhiro Ito et al.

It is certified that error appears in the above-identified patent and that said Letters Patent is hereby corrected as shown below:

Column 25,
Line 34, “restarts” should read -- restart --.
Line 55, “Forth” should read -- Fourth --.
Line 64, “As the” should read -- As in the case of the --.

Signed and Sealed this

Thirteenth Day of September, 2005

JON W. DUDAS
*Director of the United States Patent and Trademark Office*